US008636049B2

(12) United States Patent
Oya et al.

(10) Patent No.: US 8,636,049 B2
(45) Date of Patent: Jan. 28, 2014

(54) FLASKLESS MOLDING METHOD AND A FLASKLESS MOLDING MACHINE

(75) Inventors: Toshihiko Oya, Toyokawa (JP); Kazunori Ogura, Toyokawa (JP)

(73) Assignee: Sintokogio, Ltd., Aichi (JP)

( * ) Notice: Subject to any disclaimer, the term of this patent is extended or adjusted under 35 U.S.C. 154(b) by 0 days.

(21) Appl. No.: 13/504,788

(22) PCT Filed: Feb. 28, 2011

(86) PCT No.: PCT/JP2011/054535

§ 371 (c)(1),
(2), (4) Date: Apr. 27, 2012

(87) PCT Pub. No.: WO2012/011300

PCT Pub. Date: Jan. 26, 2012

(65) Prior Publication Data

US 2013/0118702 A1 May 16, 2013

(30) Foreign Application Priority Data

Jul. 23, 2010 (JP) ..... 2010-165694
Oct. 6, 2010 (JP) ..... 2010-226376
Nov. 29, 2010 (JP) ..... 2010-265222

(51) Int. Cl.
*B22C 11/04* (2006.01)
*B22C 11/10* (2006.01)

(52) U.S. Cl.
USPC ..... 164/37; 164/184

(58) Field of Classification Search
USPC ..... 164/19–22, 37, 172, 184, 195, 164/200–202, 207, 410
See application file for complete search history.

(56) References Cited

U.S. PATENT DOCUMENTS 3,828,840 A 8/1974 Lund et al.
3,878,881 A 4/1975 Lund et al.

(Continued)

FOREIGN PATENT DOCUMENTS

JP 51-26291 8/1976
JP 61-97344 6/1986

(Continued)

OTHER PUBLICATIONS

PTO translation of JP 01-306044 A. May 2013.*

(Continued)

*Primary Examiner* — Kevin P Kerns
*Assistant Examiner* — Kevin E Yoon
(74) *Attorney, Agent, or Firm* — Finnegan, Henderson, Farabow, Garrett & Dunner, L.L.P.

(57) ABSTRACT

To provide a method and a machine for forming flaskless molds with a shortened cycle time even if many cores are placed, to thereby achieve efficient molding. The flaskless molding machine comprises at least four pairs of upper and lower flasks 4, each pair comprising an upper flask 2 and a lower flask 3, a device 5 for pivoting the flasks to move the at least four pairs of upper and lower flasks via at least four stations, including a molding station, a first station for placing a core, a second station for placing a core, and a station for extracting the molds, a match plate 6, a pair of squeeze plates 7, 8, a storage tank 9 for sand, a device 10 for moving forward and backward around an axis that moves around the axis the upper and lower flasks where an upper mold cavity and a lower mold cavity are formed so that ports for introducing molding sand can receive the molding sand from a pair of nozzles for introducing molding sand, a squeezing device 11, a device 14 for moving the upper and lower flasks, and a device 15 for extracting the molds.

12 Claims, 34 Drawing Sheets

(56) References Cited

U.S. PATENT DOCUMENTS

| | | | | |
|---|---|---|---|---|
| 4,114,677 | A * | 9/1978 | Wernli | 164/168 |
| 4,156,450 | A * | 5/1979 | Hunter | 164/24 |
| 6,817,403 | B2 * | 11/2004 | Hunter | 164/169 |
| 2008/0169083 | A1 * | 7/2008 | Harada et al. | 164/520 |
| 2009/0078389 | A1 * | 3/2009 | Hirata et al. | 164/29 |

FOREIGN PATENT DOCUMENTS

| | | | |
|---|---|---|---|
| JP | 01-306044 | | 12/1989 |
| JP | 2006-315012 | | 11/2006 |
| JP | 4281742 | B2 | 3/2009 |
| JP | 4374619 | B | 9/2009 |
| SU | 1763080 | A1 * | 9/1992 |

OTHER PUBLICATIONS

PTO translation of JP 61-097344 U. May 2013.*

International Search Report dated May 10, 2011 issued in International Application No. PCT/JP2011/054535.

* cited by examiner

FLASKLESS MOLDING METHOD AND A FLASKLESS MOLDING MACHINE

CROSS-REFERENCE TO RELATED APPLICATIONS

This application claims the benefits of the priority of Japanese Patent Application No. 2010-165694 (filed Jul. 23, 2010), Japanese Patent Application No. 2010-226376 (filed Oct. 6, 2010), and Japanese Patent Application No. 2010-265222 (filed Nov. 29, 2010), the disclosures of which are incorporated herein in their entireties.

TECHNICAL FIELD

The present invention relates to a method and a machine for forming molds. Specifically, it relates to a method and a machine for forming an upper mold (cope) and a lower mold (drag) that are flaskless and that are stacked.

BACKGROUND ART

About a conventional flaskless molding method or machine that forms flaskless copes and drags, for example, Patent Document Nos. 1 and 2, which were filed by the assignee of the present application, are known. The molding machines disclosed in Patent Document Nos. 1 and 2 include two pairs of upper and lower flasks, a match plate, a means for feeding molding sand, a squeezing means for squeezing molding sand, a means for moving forward and backward the squeezing means around an axis, and a means for alternately pivoting the two pairs of upper and lower flasks between two stations.

The molding method that utilizes this molding machine can simultaneously perform the step of forming molds in a pair of upper and lower flasks and the step of extracting the formed molds from the pair of upper and lower flasks. Thus it can form molds in a short period and efficiently. Often a core is, as required, placed between the cope and the drag that have been molded.

However, about the conventional molding machine and method, since a long time is required for placing a core between a cope and a drag, needs for more efficiently forming molds have arisen. Further, meeting these needs is also preferable in view of efficiency where many cores are used.

PRIOR-ART PUBLICATIONS

Patent Documents

Patent Document No. 1: Japanese Patent No. 4,281,742 (Sintokogio, Ltd.)

Patent Document No. 2: Japanese Patent No. 4,374,619 (Sintokogio, Ltd.)

DISCLOSURE OF INVENTION

Problems to be Solved by the Invention

The object of the present invention is to provide a flaskless molding method and a flaskless molding machine that enable molding with many cores to be more efficiently done in a reduced cycle time.

Means for Solving the Problems

In an embodiment of the present invention, the flaskless molding method for sequentially molding a cope and a drag that are flaskless and that are stacked comprises the following steps:

(1) clamping a match plate by moving an upper flask and a lower flask to have them come close to each other, wherein the flasks are positioned to vertically face each other in a molding station, and wherein each of the flasks has an opening and a port for introducing molding sand on the side wall, (2) forming an upper mold cavity and a lower mold cavity by inserting a pair of squeeze plates in the upper and lower flasks through the openings, which flasks clamp the match plate, (3) positioning ports for introducing molding sand of the upper and lower flasks at the positions where molding sand can be introduced from a pair of nozzles for introducing molding sand by moving forward and backward the upper and lower flasks around an axis, wherein the upper and lower flasks form the upper and lower mold cavities, respectively, and the pair of nozzles for introducing molding sand are formed downward from the lower end of a storage tank for sand, (4) filling molding sand into the upper and lower mold cavities from the storage tank for sand through the ports for introducing molding sand, (5) forming molds in the upper and lower flasks by squeezing the molding sand that has been filled in the upper and lower mold cavities by moving the pair of squeeze plates toward the match plate, (6) moving forward and backward the upper and lower flasks around the axis to have them vertically face each other, (7) separating the match plate from the molds by moving the upper and lower flasks in directions to retract them from each other, wherein the molds have been formed in the upper and lower flasks, (8) moving the upper and lower flasks from the molding station to a first station for placing a core by a pivoting motion so as to have the upper and lower flasks be in a condition where a core can be placed, wherein the molds have been formed in the upper and lower flasks, (9) moving the upper and lower flasks from the first station for placing a core to a second station for placing a core by a further pivoting motion in the same direction so as to have the upper and lower flasks be in a condition where another core can be placed,

(10) moving the upper and lower flasks from the second station for placing a core to a station for extracting the molds by a further pivoting motion in the same direction,

(11) stacking the upper and lower flasks by moving them in the station for extracting the molds to have them come closer to each other, wherein the molds have been formed in the upper and lower flasks, and

(12) extracting the molds that are stacked from the upper and lower flasks by a device for extracting molds, wherein the device has a member that can go inside the upper and lower flasks that are stacked, wherein respective pairs of the upper and lower flasks, each of which consists of an upper flask and a lower flask, are put in at least four stations, including the molding station, the first station for placing a core, the second station for placing a core, and the station for extracting the molds in conditions that are suitable for the steps performed by the respective stations, and wherein the upper and lower flasks are moved via the at least four stations by pivoting motions.

In an embodiment of the present invention, the flaskless molding machine for forming an upper mold (cope) and a lower mold (drag) that are flaskless comprises the following:

a platform, four pairs of an upper flask and a lower flask, both the upper flask and the lower flask having an opening and a port for introducing molding sand on the side wall, a device for pivoting the flasks that moves the four pairs of an upper flask and a lower flask via at least four stations, including a molding station, a first station for placing a core, a second station for placing a core, and a station for extracting molds by pivoting the four pairs of an upper flask and a lower flask, a match plate that can go into and out of a gap between a pair of the upper and lower flasks of the four pairs that is situated at the molding station, a pair of squeeze plates that are inserted into the respective upper and lower flasks through their openings so as to define upper and lower mold cavities with the pair of the upper and lower flasks and the match plate while the flasks clamp the match plate that has entered the gap between them, a storage tank for sand that has a pair of nozzles for introducing molding sand and that stores molding sand, a device for moving forward and backward the upper and lower flasks around an axis so that the upper and lower flasks are moved to the positions where molding sand can be filled from the pair of nozzles for introducing molding sand to the upper and lower mold cavities through the ports for introducing molding sand, wherein the upper and lower mold cavities are formed in the upper and lower flasks, respectively, a squeezing device that drives the pair of squeeze plates so as to define the upper and lower mold cavities and that moves the pair of squeeze plates toward the match plate so as to form molds within the upper and lower flasks by squeezing the molding sand that has been filled in the upper and lower mold cavities, a device for moving upper and lower flasks that moves the upper and lower flasks so that they come close to and then retract from each other, and that retracts the upper and lower flasks so that the match plate is separated from the molds that are contained in the upper and lower flasks, a device for extracting the molds that extracts, from the upper and lower flasks, the cope (the upper mold) and drag (the lower mold) that are stacked, after the upper and lower flasks are moved to the station for extracting the molds via the first and second stations for placing a core by the device for pivoting the flasks, wherein the upper and lower flasks contain the molds that have been separated from the match plate.

Advantageous Effects of the Invention

By the present invention, a long period can be designated to place cores within a particular cycle time. Thus, needs for efficiently forming molds can be met. That is, the present invention achieves efficient molding in a reduced cycle time even when many cores are placed.

BRIEF DESCRIPTION OF DRAWINGS

The accompanying drawings, which are incorporated in and constitute part of this specification, illustrate embodiments of the invention, and together with the description, serve to explain the principles of the invention.

FIG. 4 illustrates the state when a match plate is carried in.

FIG. 5 illustrates the state when the upper mold cavity and lower mold cavity are formed.

FIG. 6 illustrates the state when the upper and lower flasks are moved around the axis to face each other in a horizontal direction.

FIG. 7 illustrates the state when molding sand is filled in the upper and lower flasks that are horizontally positioned.

FIG. 8 illustrates the state when the molding sand is squeezed.

FIG. 9 illustrates the state when the upper and lower flasks are moved around the axis to face each other in a vertical direction.

FIG. 10 illustrates the state when the pattern is taken out.

FIG. 11 illustrates the state when the match plate is carried out of the flasks.

FIG. 12 illustrates the state when the flasks with the molds are pivoted to the station for extracting the molds.

FIG. 13 illustrates the state when the flasks with the molds are stacked.

FIG. 14 illustrates the state when the molds are being extracted.

FIG. 15 illustrates the state when the molds have been extracted.

FIG. 16 illustrates the state when the flaskless upper and lower molds are pushed out of the molding machine.

FIG. 18 is a plan sectional view of the device for pivoting the flasks.

FIG. 19 is a plan sectional view of the device for pivoting the flasks when it is pivoting.

FIG. 20 is a side view of the device for pivoting the flasks.

FIG. 21 is a side view of the device for pivoting the flasks when it is connected to a driver and where the lock for positioning is unlocked.

FIG. 22 is a side view of the device for pivoting the flasks when it extends the rod of the driving cylinder and pivots it. It corresponds to FIG. 19.

FIG. 23 is a side view of the device for pivoting the flasks when the lock for positioning is locked and the device is disconnected from a driver.

FIG. 24 is a longitudinal section view of the revolute joint and the shaft for rotating it (in FIG. 24, the arrows A to E denote the views for FIGS. 25 to 29, respectively).

FIG. 25 is a sectional view of the revolute joint as viewed from the arrows A-A.

FIG. 26 is a sectional view of the revolute joint as viewed from the arrows B-B.

FIG. 27 is a sectional view of the revolute joint as viewed from the arrows C-C.

FIG. 28 is a sectional view of a rotary shaft that is connected to the revolute joint as viewed from the arrows D-D.

FIG. 29 is a sectional view of the rotary shaft as viewed from the arrows E-E.

FIG. 35 is a schematic front view of the molding machine.

FIG. 36 is a view of the pushing member when it suctions sand.

FIG. 37 is a view of the pushing member when it pushes the molds after it suctions sand.

FIG. 38 is a view of the pushing member when it finishes pushing the molds.

BEST MODE FOR CARRYING OUT THE INVENTION

Figure 1:
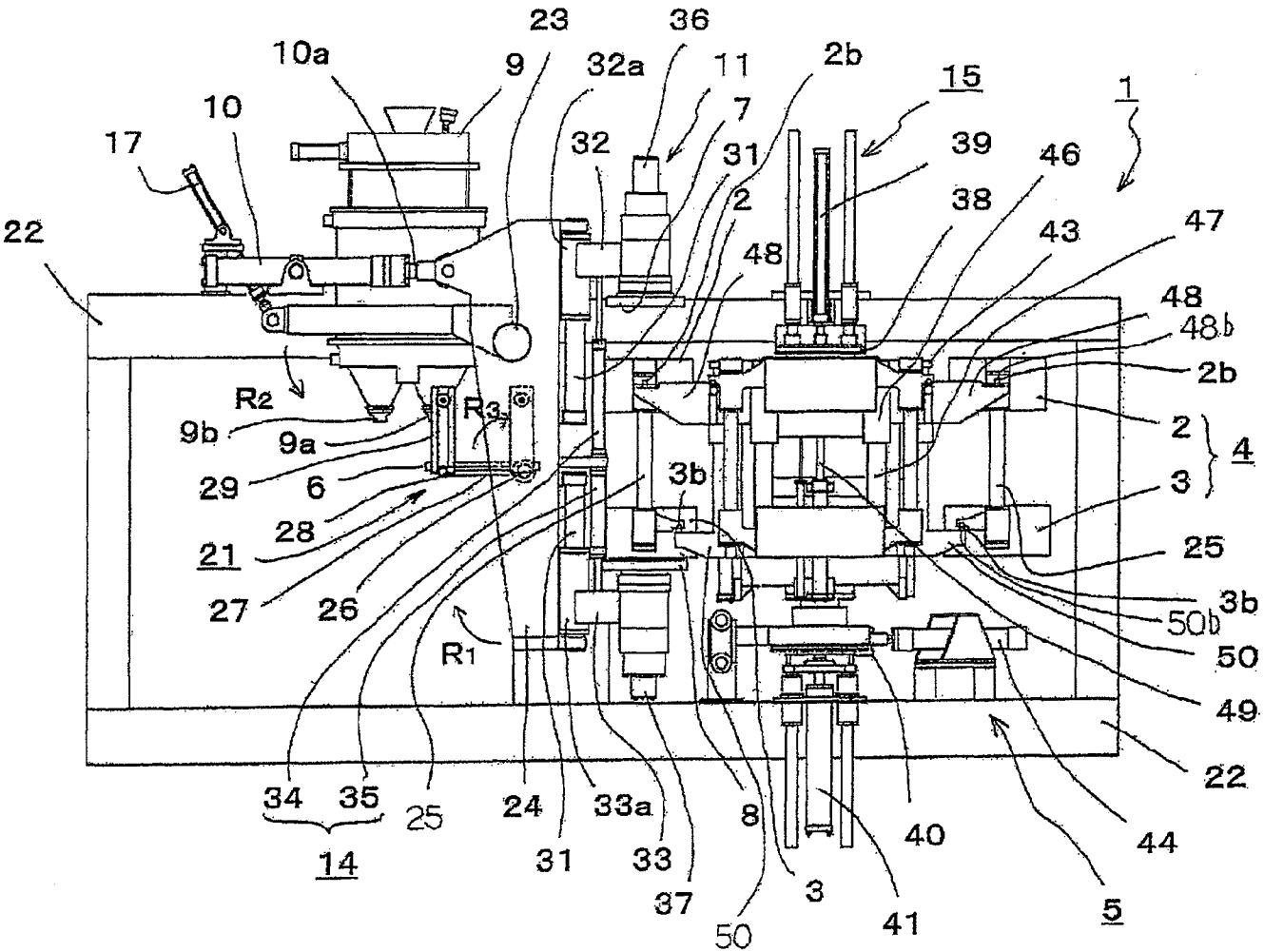
FIG. 1 is a front view of an embodiment of the molding machine of the present invention.
Figure 2:
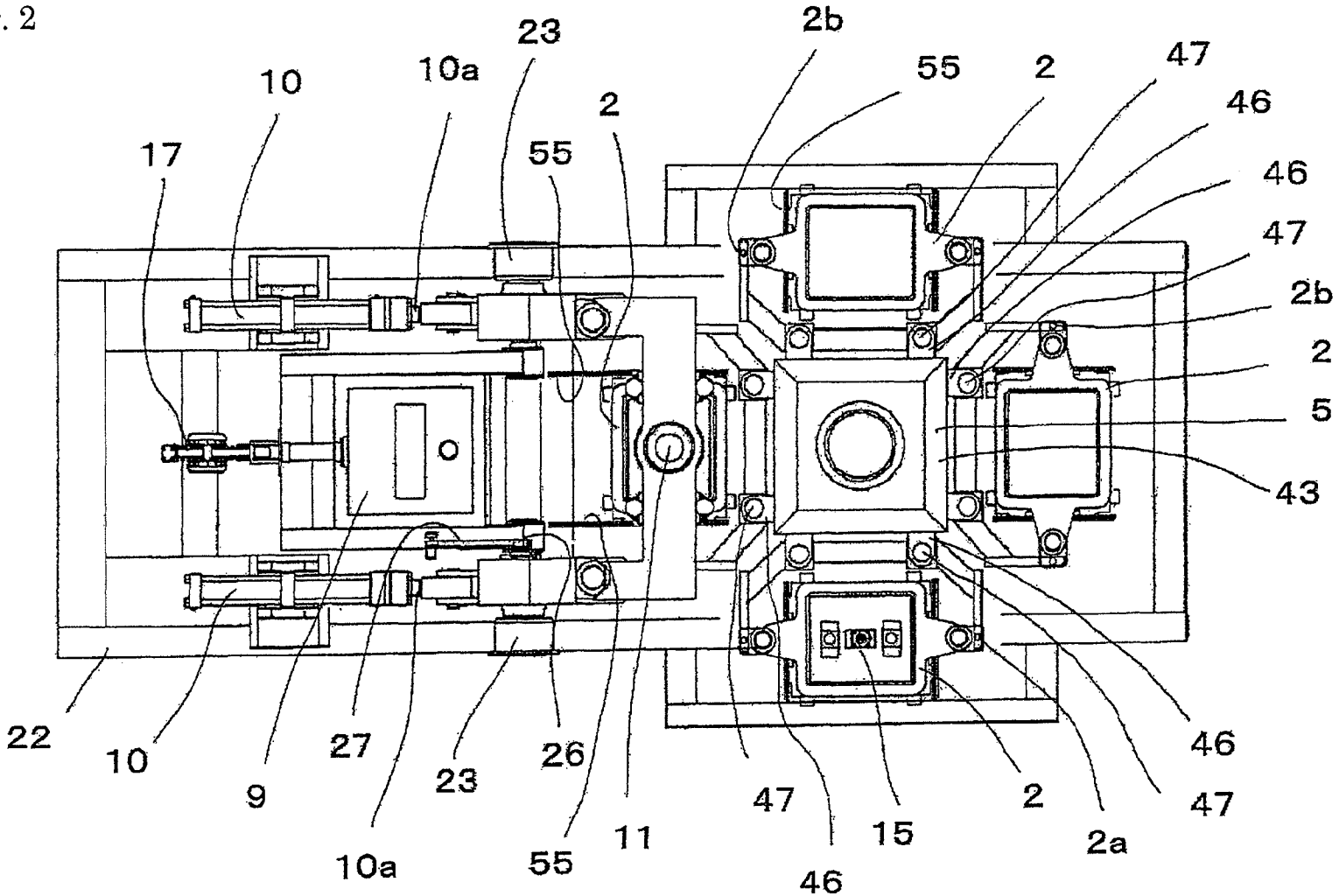
FIG. 2 is a plan view of the molding machine in FIG. 1.
Figure 3:
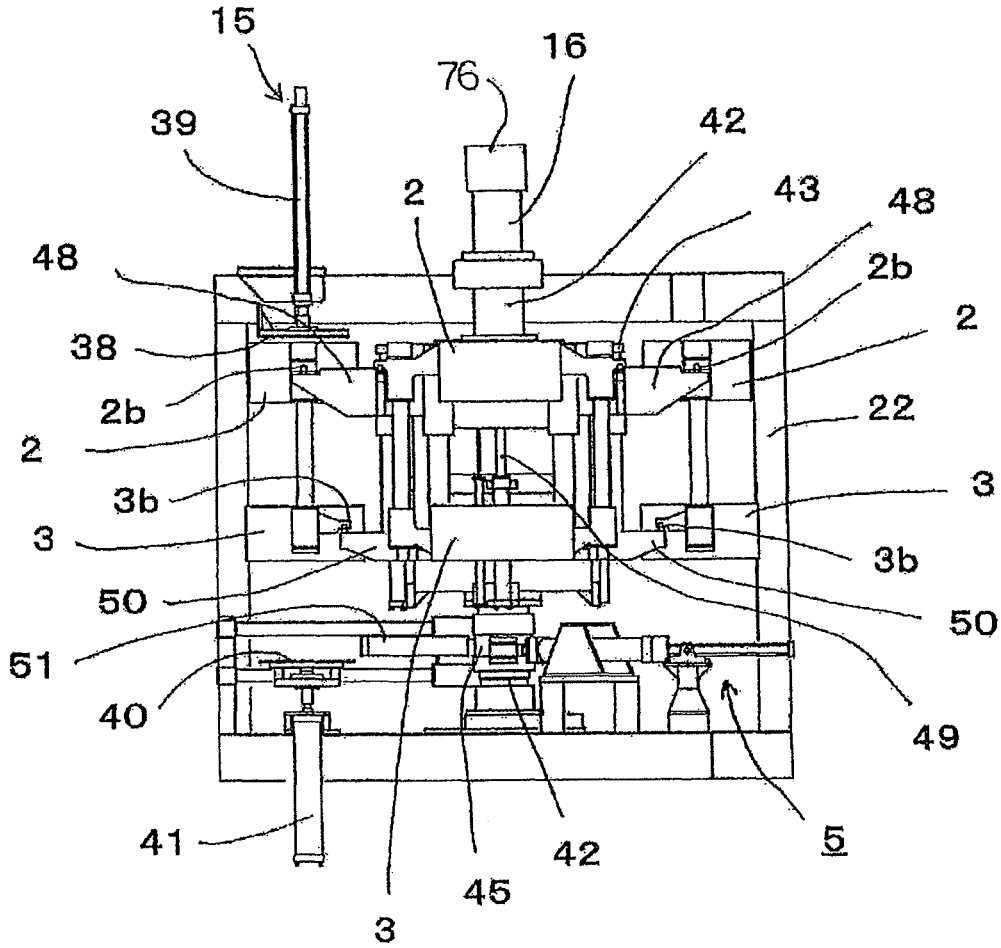
FIG. 3 is a side view of the molding machine in FIG. 1.

Below, the flaskless molding machine (below, "molding machine") and the flaskless molding method of the present invention are described with reference to the drawings. FIGS. 1, 2, and 3 are "front," "plan," and "side" views of the molding machine 1 of the present invention, respectively. FIGS. 4 to 16 are front or sectional views of the molding machine 1 showing the respective steps of molding by means of it.

As shown in FIGS. 1, 2, and 3, the molding machine 1 comprises, as main components, a frame-shaped platform 22, four pairs of upper and lower flasks 4, each of which has a respective upper flask 2 and lower flask 3, a device 5 for pivoting the flasks, a match plate 6, a pair of squeeze plates 7, 8, a storage tank 9 for sand, a device 10 for moving forward and backward around an axis, a squeezing device 11, a device 14 for moving the upper and lower flasks, and a device 15 for extracting the molds.

The upper and lower flasks 4 have a pair of an upper flask 2 and a lower flask 3. Four pairs of the upper and lower flasks 4 are provided. Both the upper flask 2 and the lower flask 3 have openings in their tops and bottoms. Ports 2*a*, 3*a* for introducing molding sand are disposed on the side walls of the upper flask 2 and the lower flask 3 so as to supply the molding sand to them. The side walls are formed in a direction perpendicular to the direction where the upper and lower flasks face each other.

The device 5 for pivoting the flasks pivots the four pairs of the upper and lower flasks 4 via at least four stations, including a molding station, a first station for placing a core, a second station for placing a core, and a station for extracting the molds.

The molding station is a location where molds are formed by squeezing the molding sand in the mold cavities. The first and second stations for placing a core are locations where a core is placed on the molds that have been formed by the molding station.

The station for extracting the molds is the location where the molds are extracted from the flasks. The device 5 for pivoting the flasks intermittently pivots the four pairs of the upper and lower flasks that are horizontally arranged. Each of the pairs have the upper flask and lower flask that are vertically positioned. The pairs of the flasks move through a squeezing device 11 where the pair of the upper flask 2 and lower flask 3 are horizontally positioned, through a device 15 for extracting the molds, and through two devices for placing a core in the upper and lower flasks manually or by a machine. The device 5 for pivoting the flasks can move up and down the upper flask 2 by hooking it.

Virtual centerlines of the upper and lower flasks at the four stations are, for example, divided equally by 90° in the direction of the pivoting. The molding machine 1 of this type is able to have two stations for placing a core. Thus the cycle time is prevented from becoming longer. In comparison with a so-called two-station system, the time for pivoting can be reduced since the angle to intermittently pivot is half of that for the two-station system. As a result, the time designated to place a core increases. In addition, since the number of stations for placing a core increases, the relative time designated to place a core in relation to the cycle time increases.

The device 5 for pivoting the flasks is preferably configured to continuously pivot the four pairs of the upper and lower flasks 4 in one direction. Thus the device 5 for pivoting the flasks in the present embodiment has a revolute joint 16 that connects an air-supplying tube and a hydraulic tube to the rotary portion.

The match plate 6 is inserted between, and taken out from, the upper and lower flasks 4, which are the pair of the four pairs that is positioned at the molding station. The match plate 6 is inserted in, and taken out, by a device 21 for inserting and taking out the match plate. On both sides of the match plate 6 patterns are placed.

A pair of squeeze plates 7, 8 are inserted through the openings of the upper and lower flasks 4 to form an upper cavity and a lower cavity. The upper and lower flasks 4 clamp the match plate 6 that is inserted between them. In other words, the squeeze plate 7 for the upper flask 2 is configured to go in and out through the opening at the top of the upper flask 2, which is not the opening where the match plate 6 is positioned. The squeeze plate 8 for the lower flask 3 is configured to go in and out through the opening at the bottom of the lower flask 3, which is not the opening where the match plate 6 is positioned.

The storage tank 9 for sand has a pair of nozzles 9*a*, 9*b* for introducing molding sand to fill the molding sand in the upper and lower cavities. The nozzles are formed downwardly from the lower end of the storage tank 9. The molding sand is stored in the storage tank 9 for sand. It is supplied into the upper and lower flasks through the pair of nozzles 9*a*, 9*b* for introducing molding sand.

The device 10 for moving forward and backward around an axis moves the upper and lower flasks 4 around a horizontal axis to locate the ports 2*a*, 3*a* for introducing molding sand at positions where the molding sand is filled through the pair of nozzles 9*a*, 9*b* for introducing molding sand. The upper and lower flasks 4 form the upper and lower cavities, respectively. As a specific example, the ports 2*a*, 3*a* for introducing molding sand contact the pair of nozzles 9*a*, 9*b* for introducing molding sand so that the molding sand can fill the flasks. Elastic sealants may be installed on the faces of the ports 2*a*, 3*a* for introducing molding sand that contact the pair of nozzles. The sealants may prevent the molding sand from spilling out through the contacted surfaces. The device 10 is a cylinder that is horizontally positioned. It moves a frame 24 for moving around an axis in the direction R1 by elongating a rod 10*a*. The frame 24 is connected to the leading end of the rod 10*a*. The device 10 for moving forward and backward around an axis moves forward and backward the squeezing device 11 and the upper and lower flasks 4 that are held by the squeezing device 11, the match plate 6, the pair of squeeze plates 7, 8, and so on around the axis in the direction R1 and its reverse direction via the frame 24 for moving around an axis.

The squeezing device 11 is moved by the device 10 and moves the pair of squeeze plates 7, 8 toward the match plate 6 to squeeze the molding sand that is filled in the upper and lower mold cavities. The squeezing device 11 also moves the pair of squeeze plates 7, 8 so that they come close to, and retract from, each other, when the upper and lower mold cavities are formed. The squeezing device 11 can move the upper and lower flasks 4 forward and backward around the axis to have them horizontally and vertically face each other.

Herein, the wording "the upper and lower flasks 4 facing vertically" means that the upper flask 2 and the lower flask 3 are placed horizontally. The wording "the upper and lower flasks 4 facing horizontally" means that the upper flask 2 and the lower flask 3 are placed vertically.

The squeezing device 11 is attached to the frame 24 for moving around an axis. The frame 24 moves forward and backward around a supporting shaft 23 in relation to a platform 22, which is a frame constructed like a rectangular parallelepiped that has a space in it for housing the structure that is discussed above. The supporting shaft 23 is attached to the platform 22 and horizontally placed. The device 10 for moving forward and backward around an axis may be, for example, a cylinder system that is horizontally placed. The leading end of the rod 10*a* of the device 10 is connected to the frame 24 at the position that is above the supporting shaft 23. The squeezing device 11 is attached to the frame 24. By elongating and contracting the rod 10*a* the frame 24 and the squeezing device 11 that is attached to the frame 24 move forward and backward around the axis so as to change the direction of the upper and lower flasks 4.

The device 14 for moving the upper and lower flasks moves the upper and lower flasks 4 to have them retract from each other so as to disengage the match plate 6 from the molds 12, 13, which are formed in the upper and lower flasks 4. The device 14 also moves the upper and lower flasks 4 so that they come close to each other when clamping the match plate 6, as discussed above. Specifically, the device 14 comprises an upward cylinder 34, a downward cylinder 35, and an upward cylinder 49, which are all discussed below.

The device 15 for extracting molds extracts the upper and lower molds from the upper and lower flasks 4 while the molds are stacked. The molds are formed in the flasks 4. The flasks 4 hold the molds, from which the match plate 6 has been separated. The flasks 4 with the molds have been moved by the device 5 for pivoting the flasks to the station for extracting the molds via the first and second station for placing a core.

Figure 17:
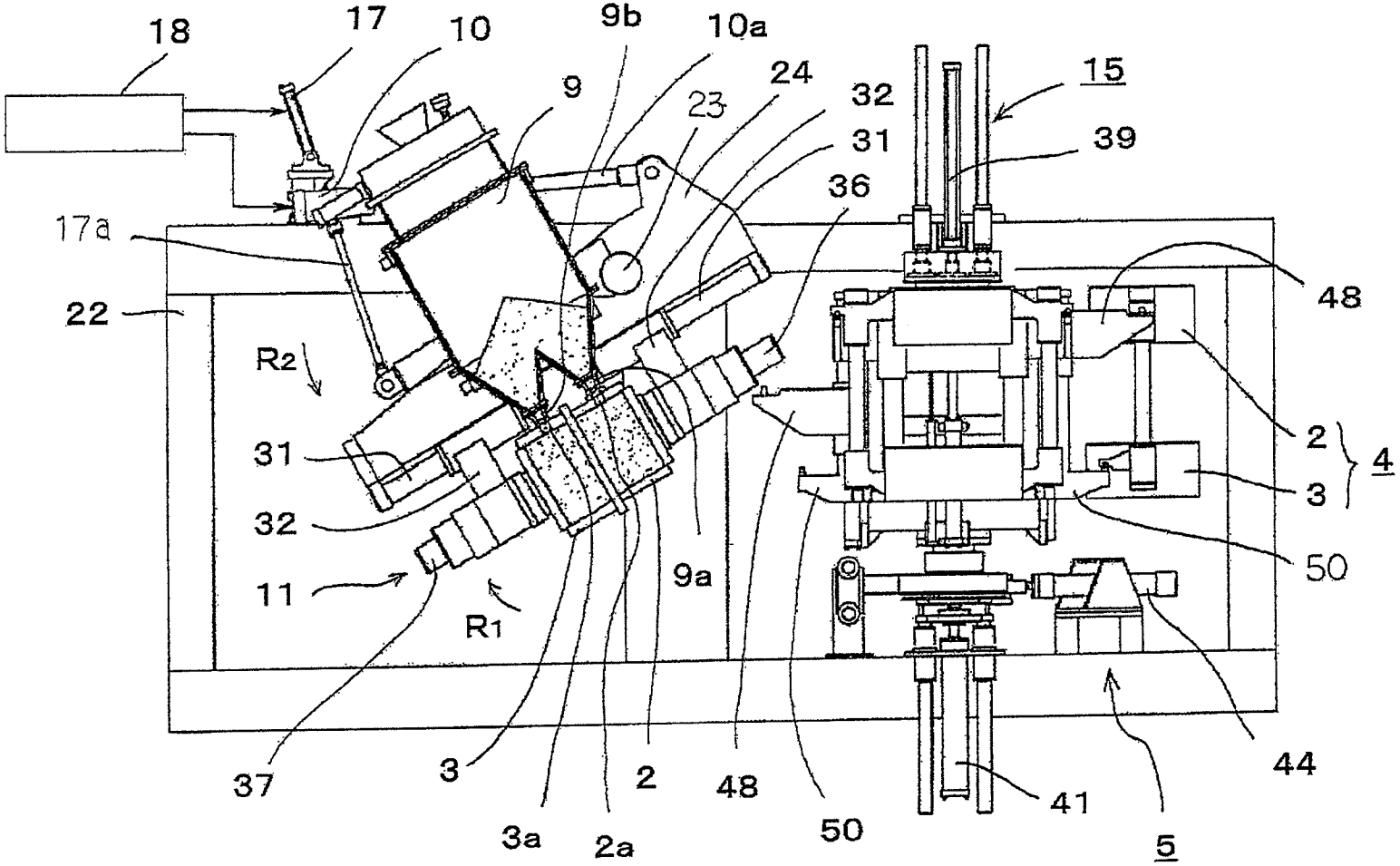
FIG. 17 is a front view illustrating another state, i.e., when the molding sand is filled in the upper and lower flasks in the molding machine of FIG. 1. While in FIG. 7 the molding sand is filled in the flasks that are in a horizontal direction, in FIG. 17 it is filled in the flasks that are in an oblique direction.

As shown in FIG. 17, the molding machine 1 also comprises a device 17 for moving, forward and backward, the storage tank for sand around an axis and a controller 18. The device 17 moves the storage tank 9 for sand around the axis in a direction R1 and its reverse direction R2. FIG. 17 shows that the molding sand is being filled in the flasks that are in an oblique position. The device 17 is a cylinder system. The leading end of a rod 17*a* is connected to the storage tank 9. The device 17 elongates the rod 17*a* to move the storage tank 9 in the direction R2. The controller 18 determines the position for filling the molding sand based on the patterns that are placed on the match plate 6. It also controls the device 10 for moving an object forward and backward around an axis and the device 17.

The controller 18 determines to fill the molding sand in a first position, which is a horizontal position, when the patterns have simple or common shapes. It determines to fill the molding sand in a second position, which is an oblique position, when the patterns have shapes that make a sleeve, and so on. It also performs controlling functions as discussed below.

The controller 18 receives, as an input, selections, for example, that are made by the user on a user interface (not shown) that has buttons to operate it. It may select the first or second position based on these selections. If a device (not shown) for automatically changing the match plate 6 is added to the molding machine 1, the signal to control this change may be input to the controller 18 so that it selects the first or second position based on this signal.

Figure 5:
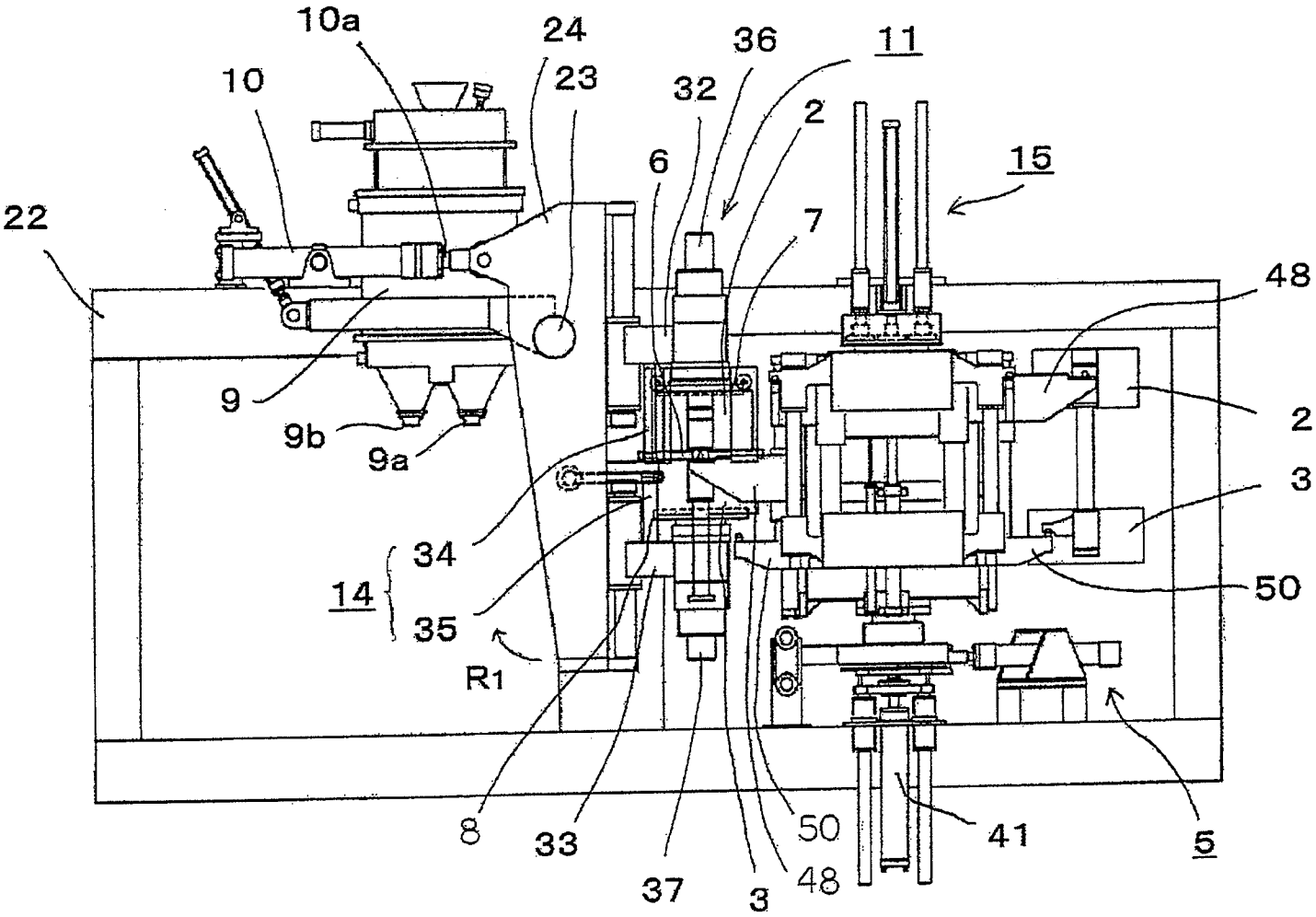
Figure 6:
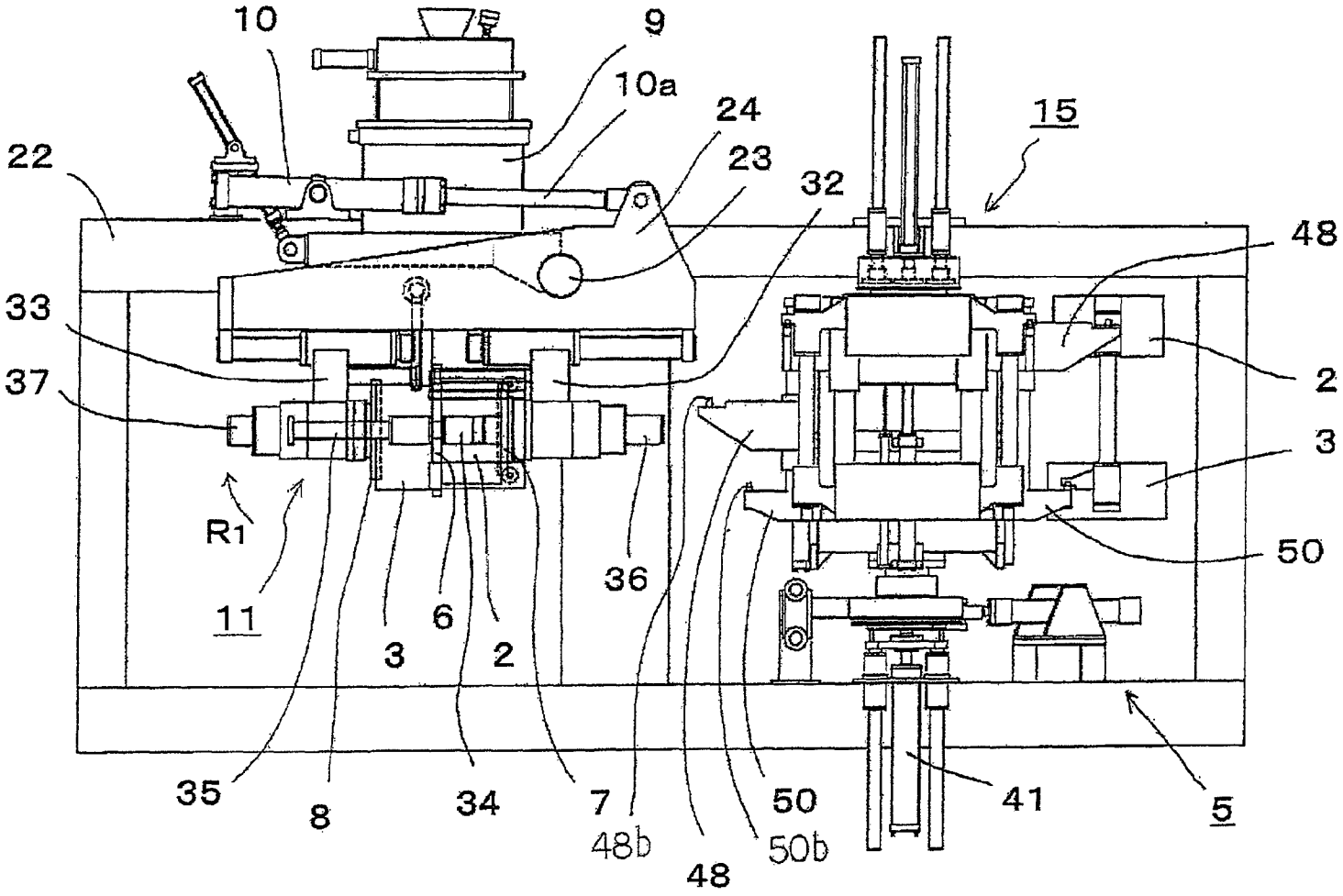

When the controller 18 determines the first position, it controls the device 10 so as to move the upper and lower flasks 4 around the axis in the direction R1 from the position where they vertically face each other to the position where they horizontally face each other, as shown in FIGS. 5 and 6. After this movement, the ports 2*a*, 3*a* for introducing molding sand can receive the molding sand from the pair of nozzles 9*a*, 9*b* for introducing molding sand.

When the controller 18 determines the second position, it controls the device 10 to move the upper and lower flasks 4 around the axis in the direction R1 from the position where they vertically face each other to the oblique position, which is between the positions where they vertically face each other and where they horizontally face each other, as shown in FIG. 17. It also controls the device 17 to move the storage tank 9 for sand around the axis in the direction R2 that is the reverse of the direction R1, which is the direction of the movement of the upper and lower flasks 4. After this movement, the ports 2*a*, 3*a* for introducing molding sand can receive the molding sand from the pair of nozzles 9*a*, 9*b* for introducing molding sand.

The oblique position, i.e., the second position, has preferably the same oblique angle as the angle of repose of the powdery molding sand. Specifically, the direction at which the upper and lower flasks face each other is preferably between 25° and 35° to the horizontal plane. Especially, it was found that the angle 30° is preferable to form the molds for a sleeve that is made by combining cylinders. Incidentally, for the oblique angle, ±1° is considered to be within the range of allowable errors. Thus, the oblique angle between 29° and 31° is considered to be more preferable. Herein, the wording "angle of repose of the powdery molding sand" means an angle to the horizontal plane where the slope of the powder remains without collapsing when it is heaped up.

If the molding sand is filled in the second position, it is easily filled in the upper mold, but not the lower mold. Thus, for the upper mold, a match plate may be used that has a shape that makes it difficult to be filled with the sand, i.e., a shape with a sleeve. However, for the lower mold, a match plate is preferably used that has no pattern or a simple pattern that is easily filled with the sand.

Figure 7:
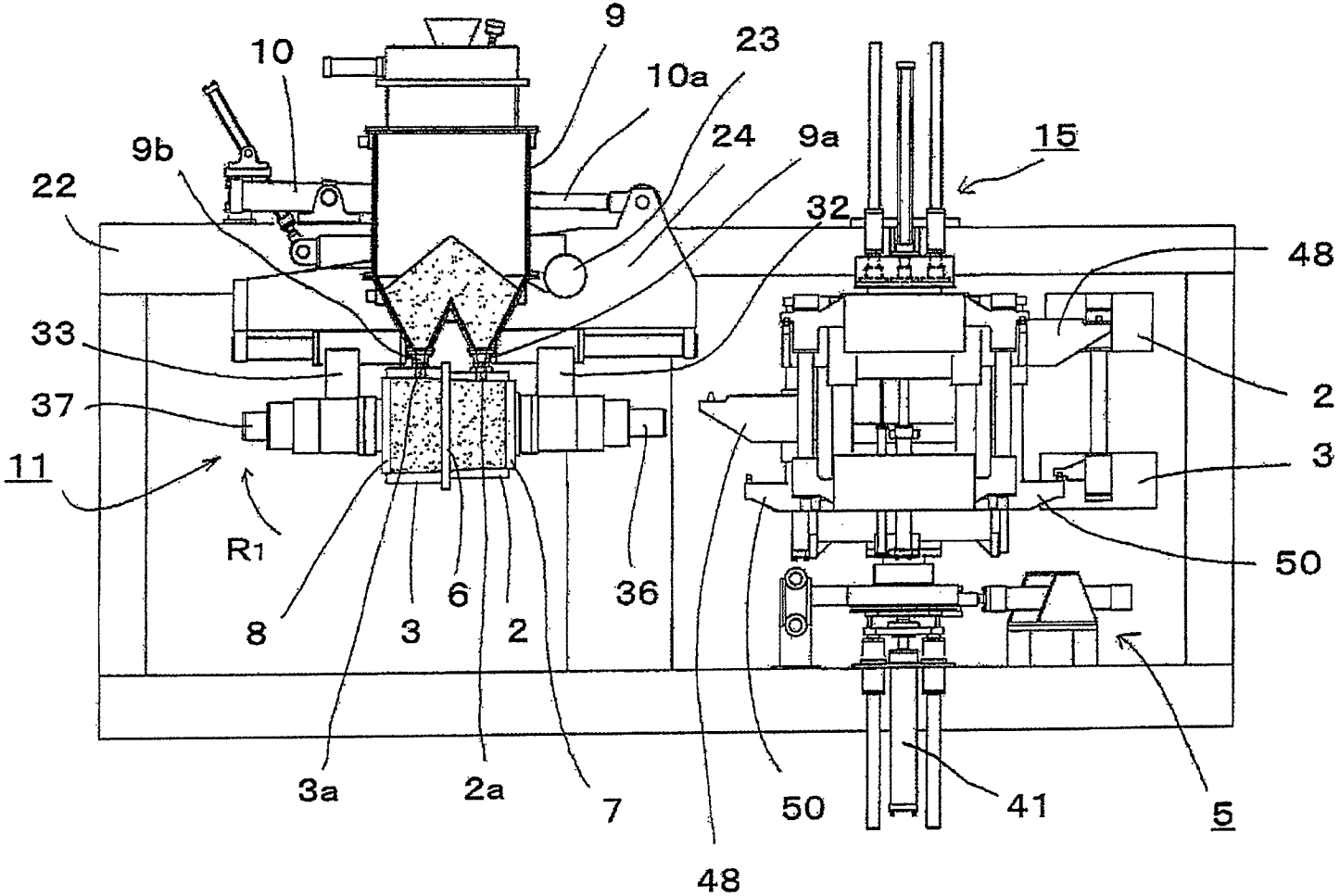

For the embodiment of the present invention, it is described that the molding machine 1 has the ability to select the first position or the second position based on the types of patterns. However, the present invention is not limited to this. The molding machine of the present invention may be configured to take only the first position (the horizontal position that is shown in FIG. 7) to introduce the molding sand. It may be configured to take only the second position (the oblique position that is shown in FIG. 17) to do so. If it takes only the first position to fill the molding sand, a device for moving the storage tank for sand forward and backward around an axis does not need to be installed.

By the molding machine 1, squeezing the molding sand as well as filling the flasks with it can be performed in the second position. The controller 18 may be configured to determine if the mold cavities are to be inclined when introducing the molding sand and squeezing it, or both.

As discussed above, the molding machine 1 has the device 10 for moving forward and backward around an axis and the device 17 for moving the storage tank for sand forward and backward around an axis so as to fill the molding sand from the storage tank 9 to the upper and lower mold cavities when the cavities are in their oblique positions. Further, the molding machine 1 enables the molding sand to be squeezed by the squeeze plates 6, 7 when the upper and lower flasks are inclined. If the storage tank 9 is inclined and aeration is used for filling the molding sand, the molding machine 1 having these distinctive features enables the molding sand to be well filled in the cavities that use a pattern that may cause trouble in filling the molding sand.

Below, more concrete constructions are discussed. In the upper and lower flasks 4, the lower flask 3 is slidably bridged over a pair of connecting shafts 25 that extend downward from the upper flask 2. It is hooked to the bottom of the shafts 25. The connecting shafts 25, which connect the upper flask 2 and the lower flask 3, are disposed on the sides of the upper and lower flasks 4, which are in the fore-and-aft positions when they move. On the side faces of the upper flask 2, which are the fore-and-aft positions when it moves, a pair of engaging concaves 2*b* are formed. They engage the convexes 48*b* of the upper hooking members 48, which are discussed below. On the side faces of the lower flask 3, which are in the fore-and-aft positions when it moves, a pair of engaging concaves 3*b* are formed. They engage the convexes 50*b* of lower hooking members 50, which are discussed below.

As shown in FIG. 1, a device 21 for inserting and taking out the match plate includes a rotary cylinder 26 that is attached to the frame 24 for moving around an axis, an arm 27 that is connected to the rotary cylinder 26 and is a cantilever, a cylinder 28 that is connected to the leading end of the arm 27, and a suspended carriage 29 that has mounted on it the match plate 6 and moves in directions for both inserting and taking out the match plate 6.

When the arm 27 moves around an axis in the direction R3 in FIG. 1 by the movement of the rotary cylinder 26, the suspended carriage 29 carries the match plate 6 into the gap between the upper flask 2 and lower flask 3 by means of a rail 55 that is installed on the flasks or the frame 24 for moving around an axis. When the arm 27 moves around the axis in the reverse direction, the suspended carriage 29 takes out the match plate 6 from the gap between the upper flask 2 and lower flask 3. By elongating and contracting the cylinder 28 that is attached to the leading end of the arm 27, the arm 27 is connected to, and disconnected from, the suspended carriage 29. When it is disconnected, the match plate 6 can be replaced. The first or second station for placing a core is used to replace the match plate 6.

As discussed above, the squeezing device 11 is supported at the point near the center of the frame 24 for moving around an axis so as to move forward and backward around the supporting shaft 23 in the vertical plane. The supporting shaft 23 is disposed at the upper and center portion of the platform 22. On the right side of the frame 24 a pair of guide rods 31 are disposed on the top and bottom sides. The guide rods extend vertically. They are separated from each other by a predetermined distance in the fore-and-aft direction. The right side of the frame 24 is its right side in FIG. 1 and the side that is near the center of the device 5 for pivoting the flasks. The fore-and-aft direction is the direction to connect the front and back in the movement around the axis and corresponds to the tangential direction in the molding station.

An upper elevating frame 32 that has a reverse L-shape and a lower elevating frame 33 that has an L-shape slidably bridge the upper and lower portions of the pair of guide rods 31 via holders 32*a* and 33*a*, respectively. The holders 32*a*, 33*a* are integrally formed on the frames 32, 33. The upper and lower elevating frames 32, 33 come close to, and retract from, each other by the elongation and contraction of the upward cylinder 34 and downward cylinder 35 that are attached to the frame 24 for moving around an axis.

A cylinder 36 for moving the upper squeeze plate 7 forward and backward is provided to the upper elevating frame 32. A cylinder 37 for moving the lower squeeze plate 8 forward and backward is provided to the lower elevating frame 33. Neither the cylinder 36 nor the cylinder 37 is necessarily a single cylinder, but either or both may be a combination of cylinders. The squeeze plates 7, 8 that are connected via the upper and lower elevating frames 32, 33 have horizontal planes of a size that can press the upper and lower flasks 2, 3.

The storage tank 9 for sand functions as a device for filling the molding sand. It is disposed on the left side of the top portion of the platform 22. It has a pair of nozzles 9*a*, 9*b* for introducing molding sand at its bottom, and so has a two-pronged shape. The storage tank 9 is manufactured by sintering ultrahigh molecular weight polyethylene on its inner face. Thus, a porous material having many holes with diameters of 10 μm to 80 μm is provided as a filter. The storage tank 9 is configured as an aeration tank that blows air through these holes so as to fluidize the molding sand when it fills the upper and lower flasks 2, 3 with sand. The molding sand is filled in the upper flask 2 and lower flask 3 separately by air at a low pressure (aeration filling). The pressure of the air at a low-pressure is preferably between 0.05 MPa and 0.18 MPa.

The device 15 for extracting molds has a pushing member 38 that can enter the upper and lower flasks that are vertically stacked and horizontally placed. The pushing member 38 is fixed to the lower end of the piston rod of the downward cylinder 39 that is attached to the top portion of the platform 22. The pushing member 38 moves up and down by the elongation and contraction of the cylinder 39. Under the pushing member 38 a table 40 is provided for receiving the upper and lower molds that are extracted from the upper and lower flasks 4. The table 40 can move up and down. The table 40 is fixed to the leading end of the piston rod of the upward cylinder 41 so as to move up and down by the elongation and contraction of the cylinder 41. A pantograph that elongates and contracts by a cylinder may be used instead of the cylinder 41. If a pantograph is used, the need to form a pit for receiving a lower portion of the cylinder 41 that extends over the bottom of the platform 22 can be eliminated.

As shown in FIGS. 1, 3, and 18 to 23, the device 5 for pivoting the flasks has a rotary frame 43, a frame 45 for transmitting a driving force, a switch 57, and a driving cylinder 44. The rotary frame 43 holds the upper and lower flasks 4 and pivots. The frame 45 for transmitting a driving force is disposed at the lower portion of the rotary frame 43 and transmits a driving force to the rotary frame 43. The switch 57 switches between a connected state, where the frame 45 and the rotary frame 43 are connected, and a disconnected state, where they are disconnected. The driving cylinder 44 moves the frame 45 forward and backward around the axis.

The driving cylinder 44 is provided on the platform 22 of the flaskless molding machine 1. The leading end 44*b* of the rod 44*a* of it is attached to an attaching portion 45*a* of the frame 45 for transmitting a driving force so as to move the frame 45 forward and backward around the axis within a range of 90° by the elongation and contraction of the rod 44*a*.

The device 5 for pivoting the flasks moves the frame 45 in one direction by switching to the connected state by the switch 57 so that the rotary frame 43 moves around the axis in one direction. When the frame 45 is to be moved in the reverse direction, the switch 57 switches to the disconnected state.

The switch 57 is a cylinder for a connection that is fixed to the attaching portion 45*b* of the frame 45. The switch 57 elongates the rod 57*a* upwardly to engage its leading end 57*b* with a concave 43*a* on the lower surface of the rotary frame 43 so as to switch to the connected state (see FIGS. 21 and 22). It contracts the rod 57*a* so as to disengage the leading end 57*b* of the rod 57*a* from the concave 43*a* to switch to the disconnected state (see FIGS. 20 and 23).

The device 5 for pivoting the flasks has a device 58 for locking the position of the rotary frame 43 in the direction to move around the axis. The device 58 is a cylinder that is provided on the platform 22. It elongates a rod 58*a* upwardly so as to engage the leading end 58*b* of the rod 58*a* with the concave 43*a* on the lower surface of the rotary frame 43. By doing so, the rotary frame 43 is accurately positioned and locked (a locked state).

More specifically, the device 5 for pivoting the flasks is equipped with a rotary shaft 42 that has a vertical longitudinal axis and is rotatably placed on the platform 22. The rotary frame 43 that holds four pairs of the upper and lower flasks 4 (the upper flask 2 and the lower flask 3) is provided on it. The driving cylinder 44 is provided on the lower portion of the rotary frame 43. The frame 45 for transmitting a driving force that moves around the rotary shaft 42 is provided at the leading end of the driving cylinder 44. The switch 57 for switching to the connected state and the device 58 for locking the position are provided on the frame 45.

Figure 18:
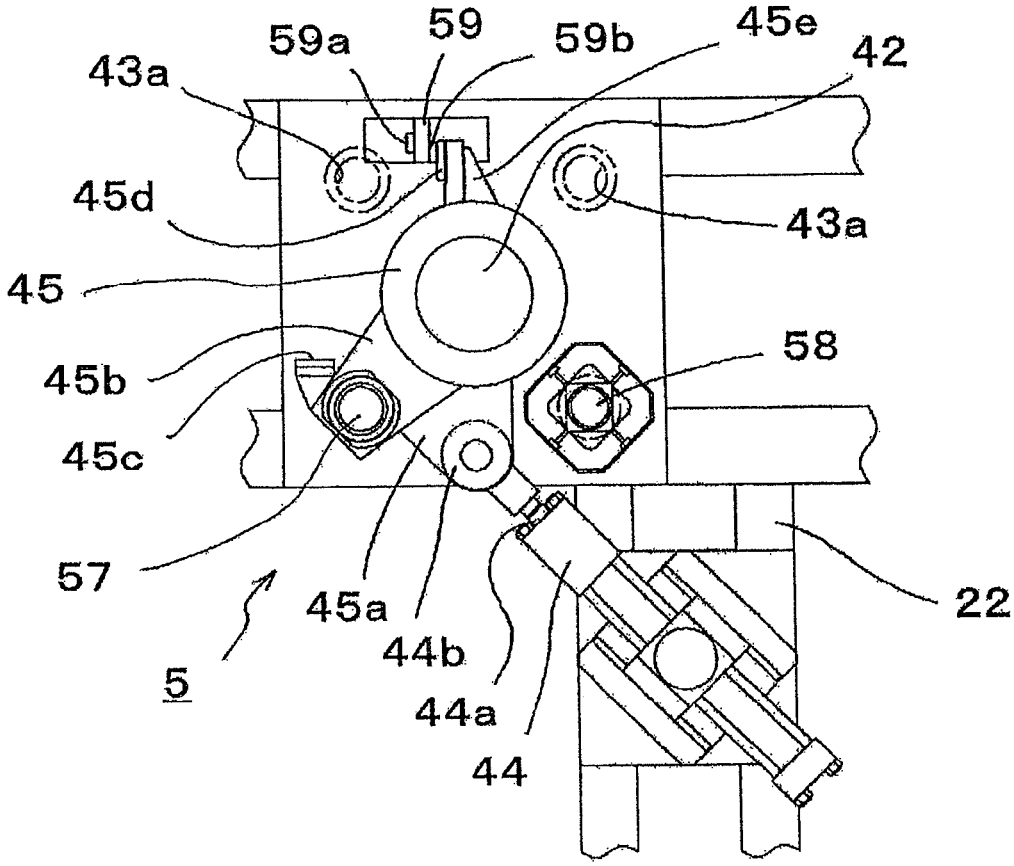
FIGS. 18 to 23 illustrate the device for pivoting the flasks in the molding machine in FIG. 1.

The device 5 for pivoting the flasks has a contacting member 59 for positioning the rotary frame 43 together with the device 58 for locking the position. A contacting portion 59*a* of the contacting member 59 contacts a contact portion 45*c* of the frame 45 that is moved around the axis by the driving cylinder 44 from the position in FIG. 18 to that in FIG. 19. The frame 45 is stopped at the position where it moves 90° by having the contacting portion 45*c* contact the contacting member 59. The driving cylinder 44 is configured to have the contacting member 59 contact the frame 45 before the rod 44*a* is elongated to the maximum extent. Since the contacting member 59 is positioned while a margin for the stroke of the driving cylinder 44 remains, the effects of thermal expansion are reduced, to thereby increase the accuracy of positioning in comparison with the traditional way, where the cylinder elongates the rod to the maximum extent to position an object. A contacting portion 59*b* that is formed at the end that is opposite the contacting portion 59*a* of the contacting member 5 contacts a contact portion 45*d* of the convex 45*e* of the frame 45 that is moved around the axis by the driving cylinder 44 from the position in FIG. 19 to that in FIG. 18. As shown in FIG. 18, the contacting member 59 contacts the frame 45 before the driving cylinder 44 contracts the rod 44*a* to the maximum extent. By the same reason as discussed above, the accuracy of the positioning increases because the contacting member 59 is positioned by the driving cylinder 44, which has a margin in the stroke.

Figure 21:
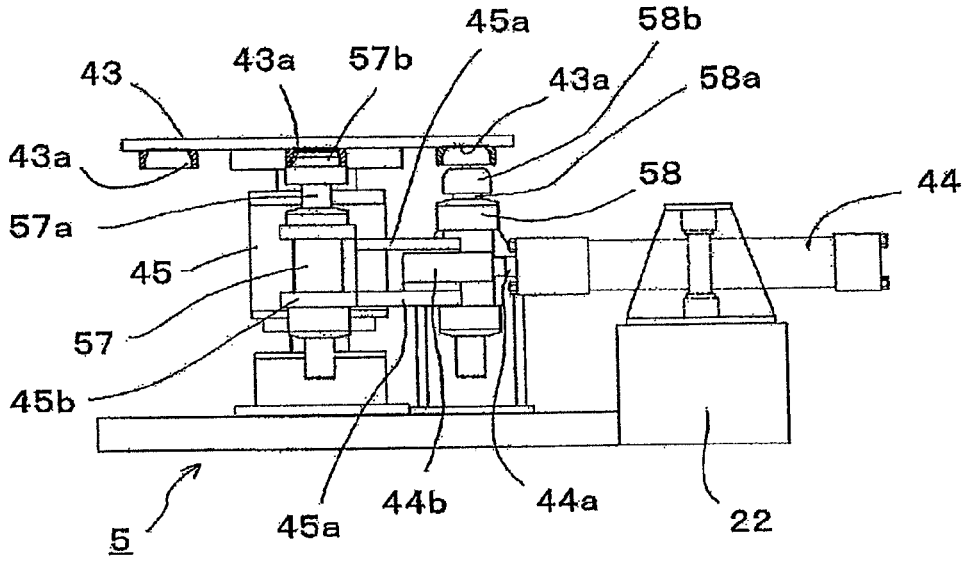

Next, the operation of the device 5 for pivoting the flasks is described. The description starts in the state shown in FIGS. 18 and 20. From this state, the rod 57*a* of the switch 57 is elongated to engage the concave 43*a* so as to be in the connected state. Then the leading end 58*b* of the rod 58*a* of the device 58 for locking the position is contracted to release the lock for positioning, as shown in FIG. 21.

Figure 19:
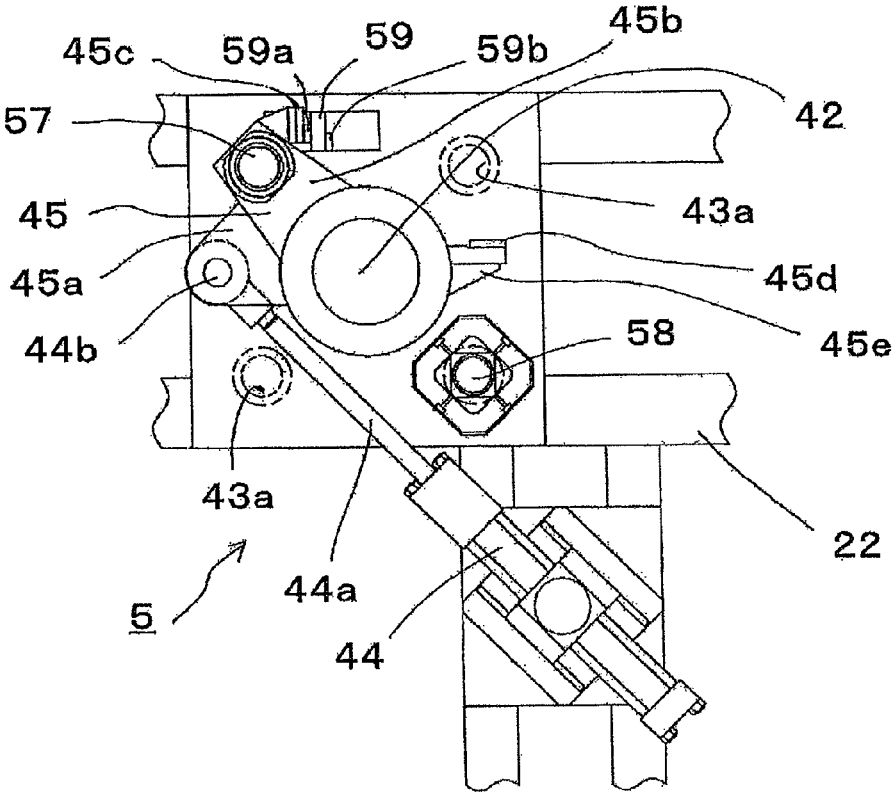
Figure 20:
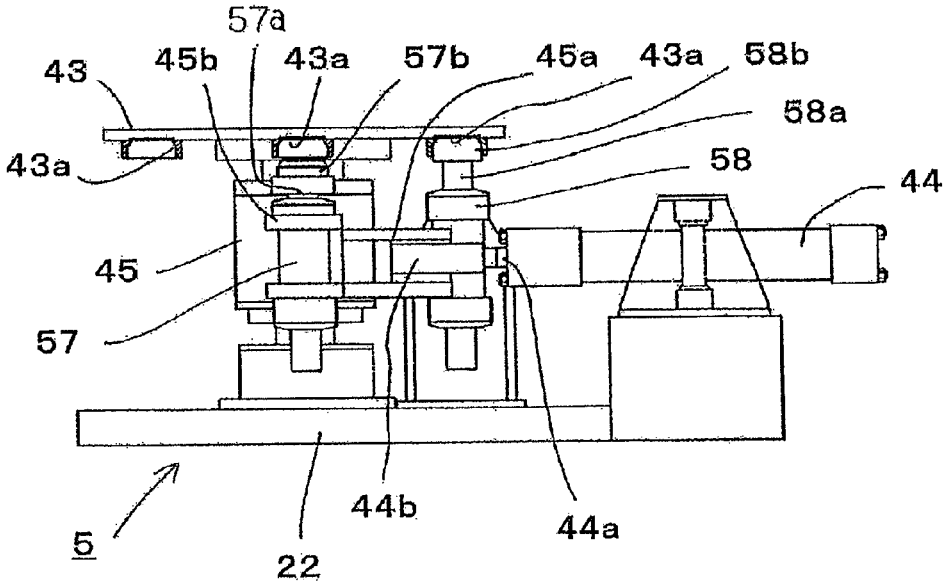
Figure 22:
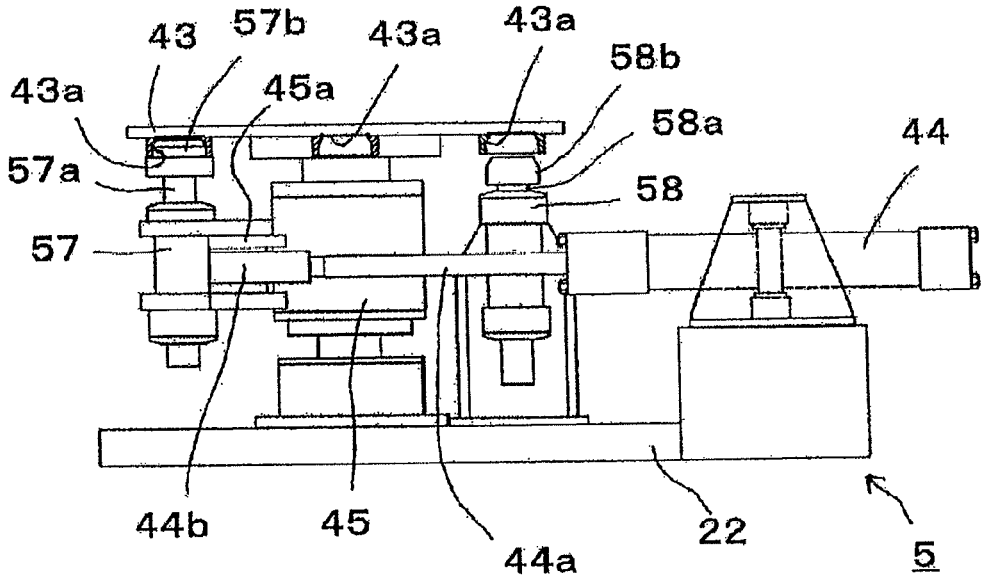
Figure 23:
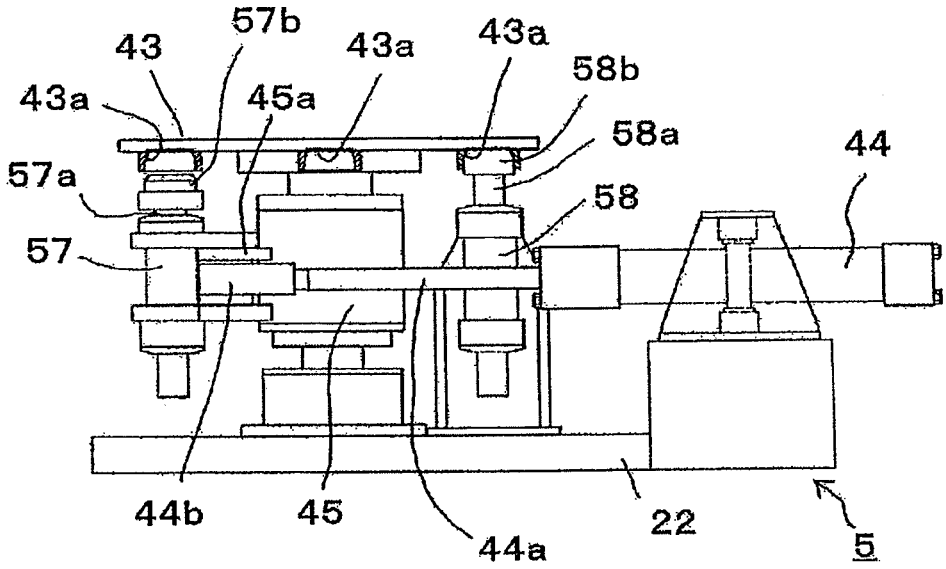
Figure 24:
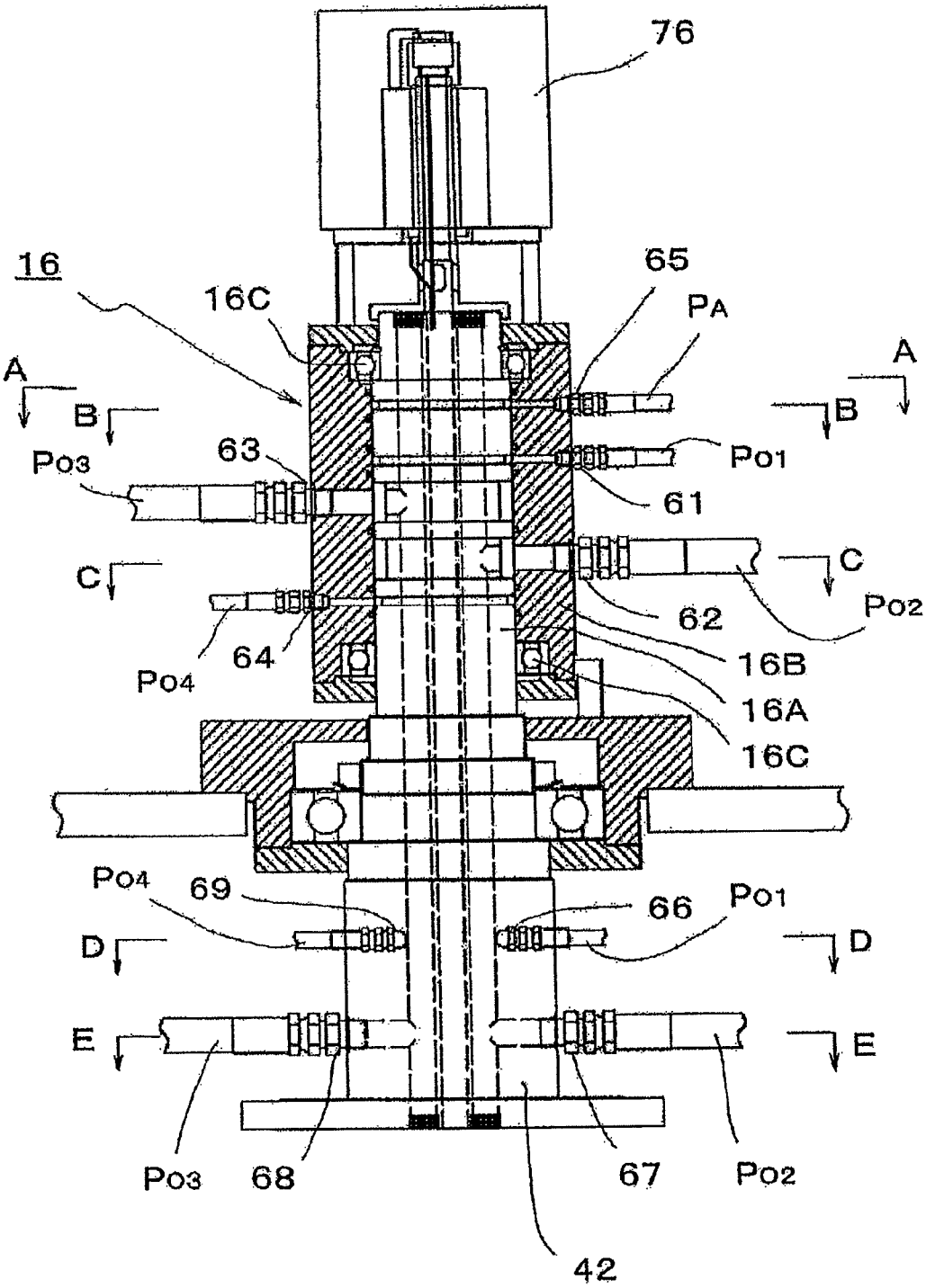
FIGS. 24 to 29 illustrate the revolute joint for a hydraulic tube or a air-supplying tube in the molding machine in FIG. 1.

Next, as shown in FIGS. 19 and 22, the rotary frame 43 and the frame 45 for transmitting a driving force are moved around the axis in the positive direction by the elongation of the driving cylinder 44 so that the rotary frame 43 contacts the contacting member 59, that is, it rotates by 90°. The positive direction is the clockwise direction on the plane in FIG. 2.

In this state, the rod 58*a* of the device 58 for locking the position is elongated so that the leading end 58*b* engages the concave 43*a*. Thus the lock for positioning is locked. Then the leading end 57*b* of the rod 57*a* of the switch 57 is contracted to disengage from the concave 43*a*. Thus they are disconnected. Then, while the rotary frame stands, the frame 45 for transmitting a driving force is moved in the reverse direction by means of the contraction of the rod 44*a* of the driving cylinder 44. They return to the positions in FIGS. 18 and 20.

As discussed above, by moving the frame 45 around the axis by 90° in the positive direction and reverse direction by switching to the connected and disconnected states of the frame 45 and the rotary frame 43, the rotary frame 43 is moved around the axis. The device 5 for pivoting the flasks repeats a set of the operations shown in FIGS. 18 to 23, to thereby rotate the rotary frame 43 in steps of 90°. When the device 5 for pivoting the flasks pivots, then, as discussed with reference to FIGS. 18 to 23, at least one of the leading end 58*b* of the device 58 for locking the position and the leading end 57*b* of the switch 57 is engaged with the concave 43*a* of the rotary frame 43. Thus the rotary frame 43 and the upper and lower flasks that are held and pivoted by it are prevented from being displaced. Thus accurate pivoting and molding can be achieved.

Supports 46 are provided in the upper portion of the rotary frame 43. Guide rods 47 are provided to the respective supports 46. They extend vertically and downwardly from the supports 46. They are positioned with a predetermined distance between them in the fore-and-aft direction, to thereby be four pairs. The four pairs of the guide rods 47 face each other in the fore-and-aft and right-and-left directions centering around the rotary frame 43.

The upper hooking members 48 are provided to each of the four pairs of the guide rods 47. They slidably bridge the pair of guide rods 47. They can engage the engaging concave 2*b* of the upper flask 2. The leading end of the piston rod of the upward cylinder 49 that is mounted on the rotary frame 43 is attached to each upper hooking member 48. Each upper hooking member 48 moves up and down by means of the elongation and contraction of the respective upward cylinders 49. The lower hooking members 50 are fixed to the bottoms of the four pairs of the guide rods 47. They can engage the engaging concaves 3*b* of the lower flask 3. The convexes 48*b* (eight in all) are provided to the upper hooking members 48 so as to engage the engaging concaves 2*b*. The convexes 50*b* (eight in all) are provided to the lower hooking members 50 so as to engage the engaging concaves 3*b*.

Hydraulic tubes to be connected by the revolute joint 16 include, for example, a hydraulic tube for driving the cylinder 49 that vertically moves the upper hooking members 48 and the upper flask 2 that is held by and that is engaged with them. Since the hydraulic tube for the cylinder 49 is joined via the revolute joint 16, the device for vertically moving the upper flask 2 can be disposed within the device 5 for pivoting the flasks and the upper and lower flasks can be continually rotated by the device 5 in one direction. Thus, first the device for vertically moving the upper flask 2 can be simplified compared to where the device is installed outside the device 5. Next, since the upper and lower flasks can continually move via the four stations in one direction, the efficiency of molding can be improved.

The air-supplying tube to be connected by means of the revolute joint 16 may include an air-supplying tube for the locking device that locks vertically the upper hooking members 48. The locking device for the upper hooking members 48 is configured to lock them when the air is not supplied and to open the lock when the air is supplied. The locking device opens the lock when the upper hooking members 48 are moved by the cylinders 49, to which the hydraulic tube is connected. It locks after the upper hooking members 48 have been moved by the cylinder 49. Since the air-supplying tube for the locking device for the upper hooking members 48 is connected via the revolute joint 16, a malfunction of the upper flask 2 can be prevented even when the supply of the hydraulic pressure is stopped due to an electric failure. Further, the upper and lower flasks can continually move in one direction.

The revolute joint 16, which is described as being connected to the hydraulic tube for the cylinder 49 that moves the upper hooking members 48, is specifically described with reference to FIGS. 24 to 29. The revolute joint 16 has a rotary portion 16A that is connected to the rotary shaft 42 and rotates, has a fixed portion 16B that is provided around the rotary portion 16A, and has a bearing 16C that rotatably supports the rotary portion 16A. In the fixed portion 16B, connections 61, 62, 63, 64 for connecting first, second, third, and fourth hydraulic tubes PO1, PO2, PO3, and PO4 to the outside, and a connection 65 for connecting the air-supplying tube PA, are provided. On the revolute joint 16, a revolute joint 76 for electric cables is provided. However, a radio system may be provided instead of the electric cables, so that no revolute joint 76 is needed.

In the rotary shaft 42, connections 66, 67, 68, 69 for connecting the first, second, third, and fourth hydraulic tubes PO1, PO2, PO3, PO4 to the device 5 that is a rotary part and a connection 70 for connecting the air-supplying tube PA are provided.

In the rotary portion 16A axial tubes 71-75 that connect these connections 61-70 are provided. The first, second, third, and fourth hydraulic tubes are used to drive the respective cylinders 49 that are disposed in the stations. The second and third hydraulic tubes PO2, PO3 are supplying and discharging tubes. The first and fourth hydraulic tubes PO1, PO4 are drainage tubes for collecting effluents. These first, second, third, and fourth hydraulic tubes can supply hydraulic pressure to any of four cylinders 49 via switching valves (not shown). The first, second, third, and fourth hydraulic tubes and the switching valves control the operations of the cylinders 49.

Figure 25:
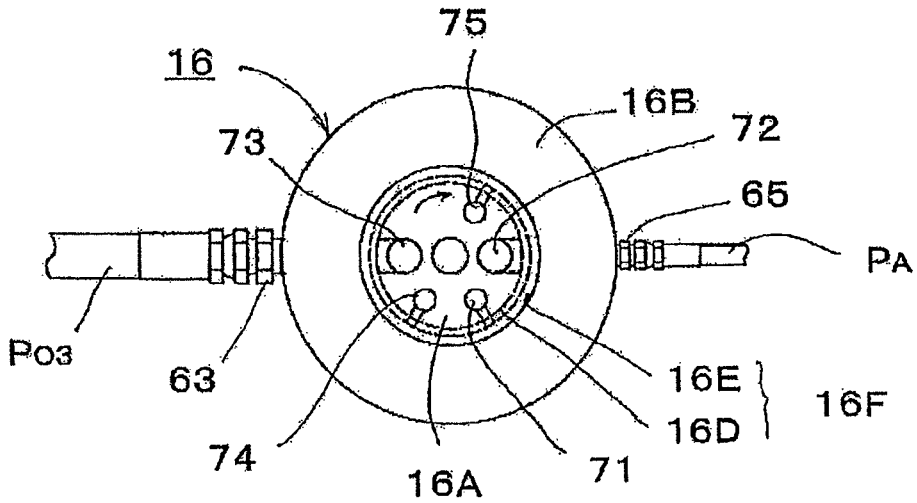
Figure 26:
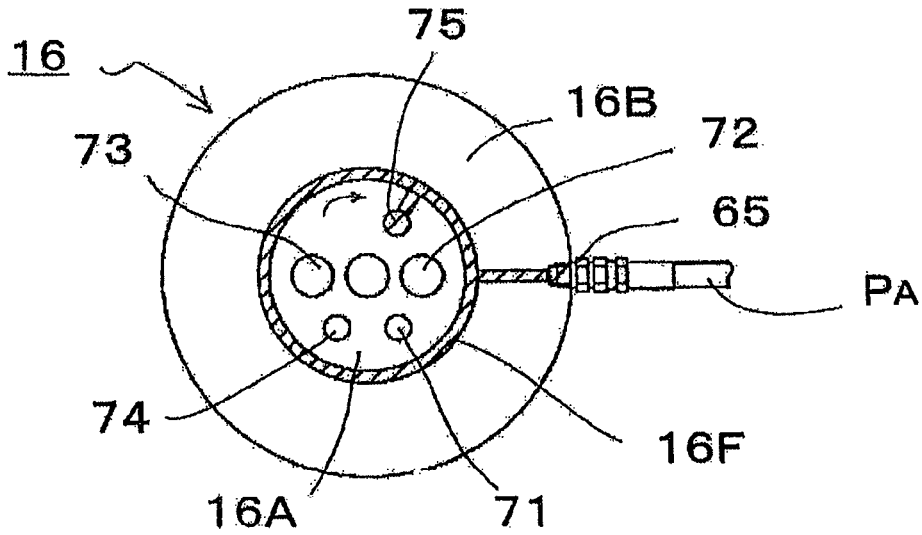
Figure 27:
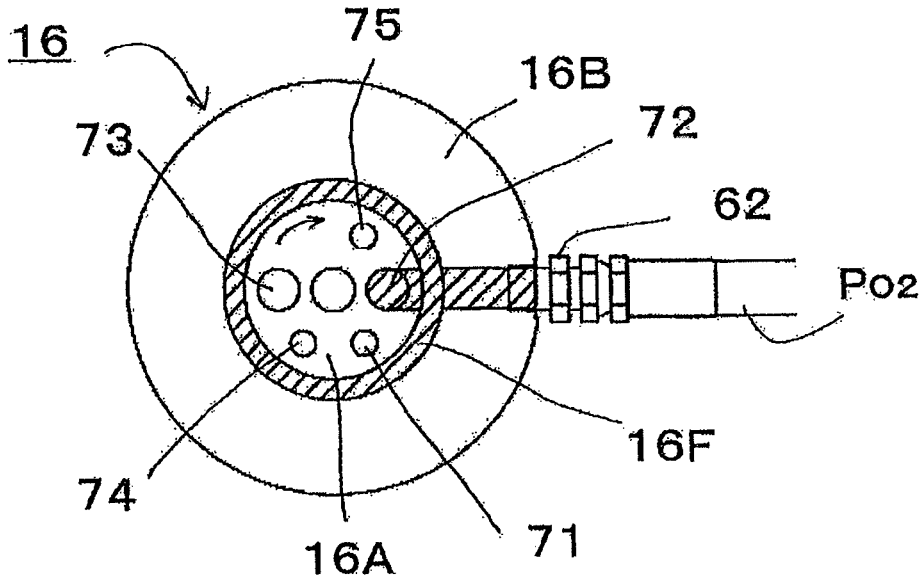
Figure 28:
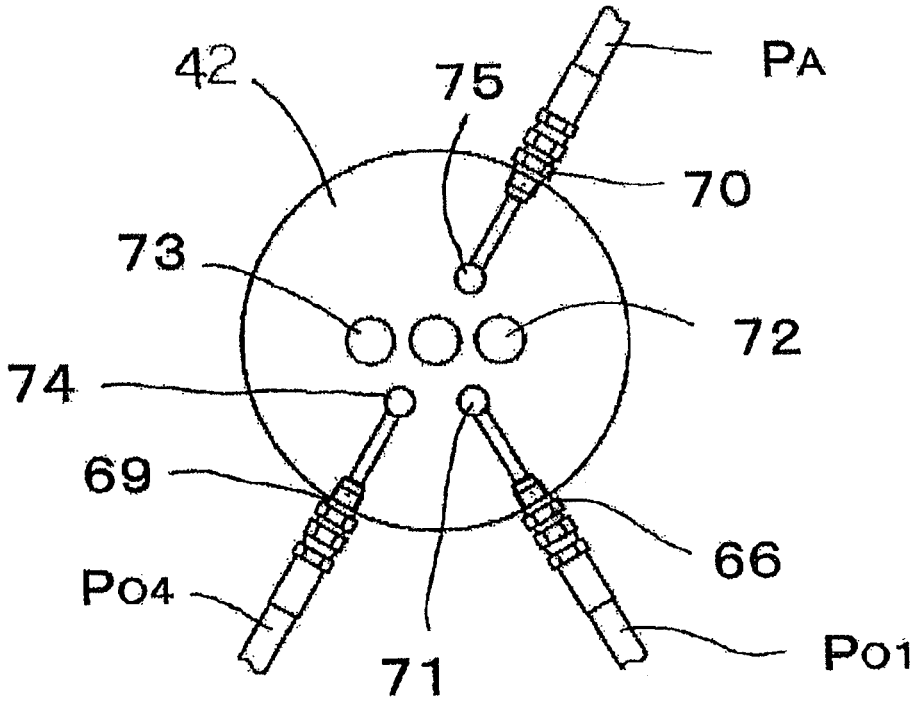
Figure 29:
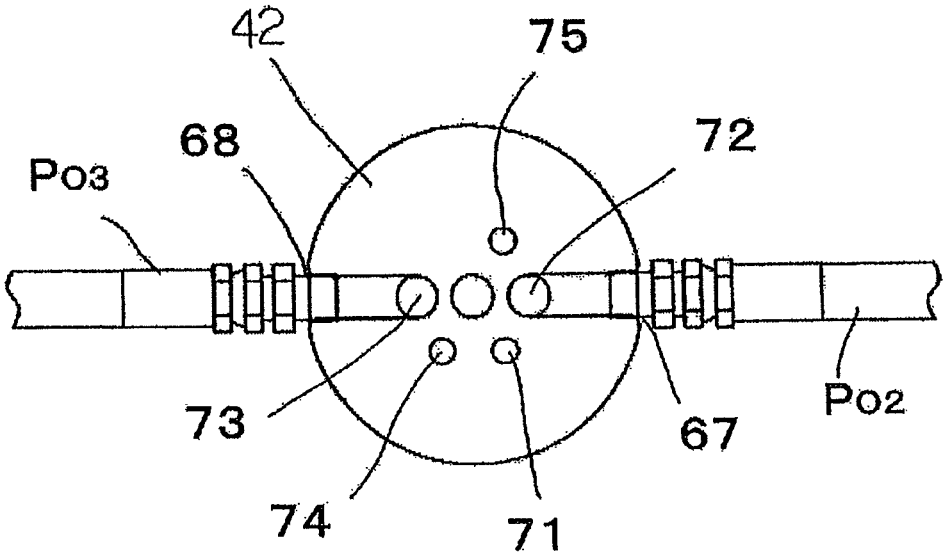

Grooves 16D, 16E are formed in the circumferential directions of the rotary portion 16A and the fixed portion 16B at the heights where the connections 61-65 are provided. These grooves 16D, 16E form circumferential grooves 16F for communicating with the tubes 71-75. For example, as shown in FIG. 25, the circumferential groove 16F is formed to communicate with the connection 65 with the axial tube 75 at the height of the connection 65. As shown in FIG. 26, the circumferential groove 16F and a radial groove are formed to have the connection 61 communicate with the axial tube 71 at the height of the connection 61. Further, as shown in FIG. 27, the circumferential groove 16F and a radial groove are formed to have the connection 62 communicate with the axial tube 72 at the height of the connection 62. As shown in FIGS. 25-29, the connections 61-65 that are disposed in the fixed portion 16B rotatably communicate with the connections 66-70 that are disposed in the rotary shaft 42 via the axial tubes 71-75, which are disposed in the rotary portion 16A, and rotate in the circumferential direction and via the grooves 16F that are formed at the heights of the respective connections 61-65. The revolute joint 16 that is constituted as discussed above enables the air-supplying tube and the hydraulic tubes to be connected to the part that rotates. That is, distinguishable effects, such as to enable the upper and lower flasks to continually rotate in one direction, can be achieved.

In the station for extracting the molds, a device 51 for discharging the molds is provided to push and discharge the upper and lower molds that have been extracted from the upper flask 2 and lower flask 3 by the device 15 for extracting molds and that have been received on the table 40 for receiving the molds.

Next, the molding method by using the molding machine 1 that is discussed above is described. This method is to form the flaskless upper and lower molds, as discussed above.

Figure 4:
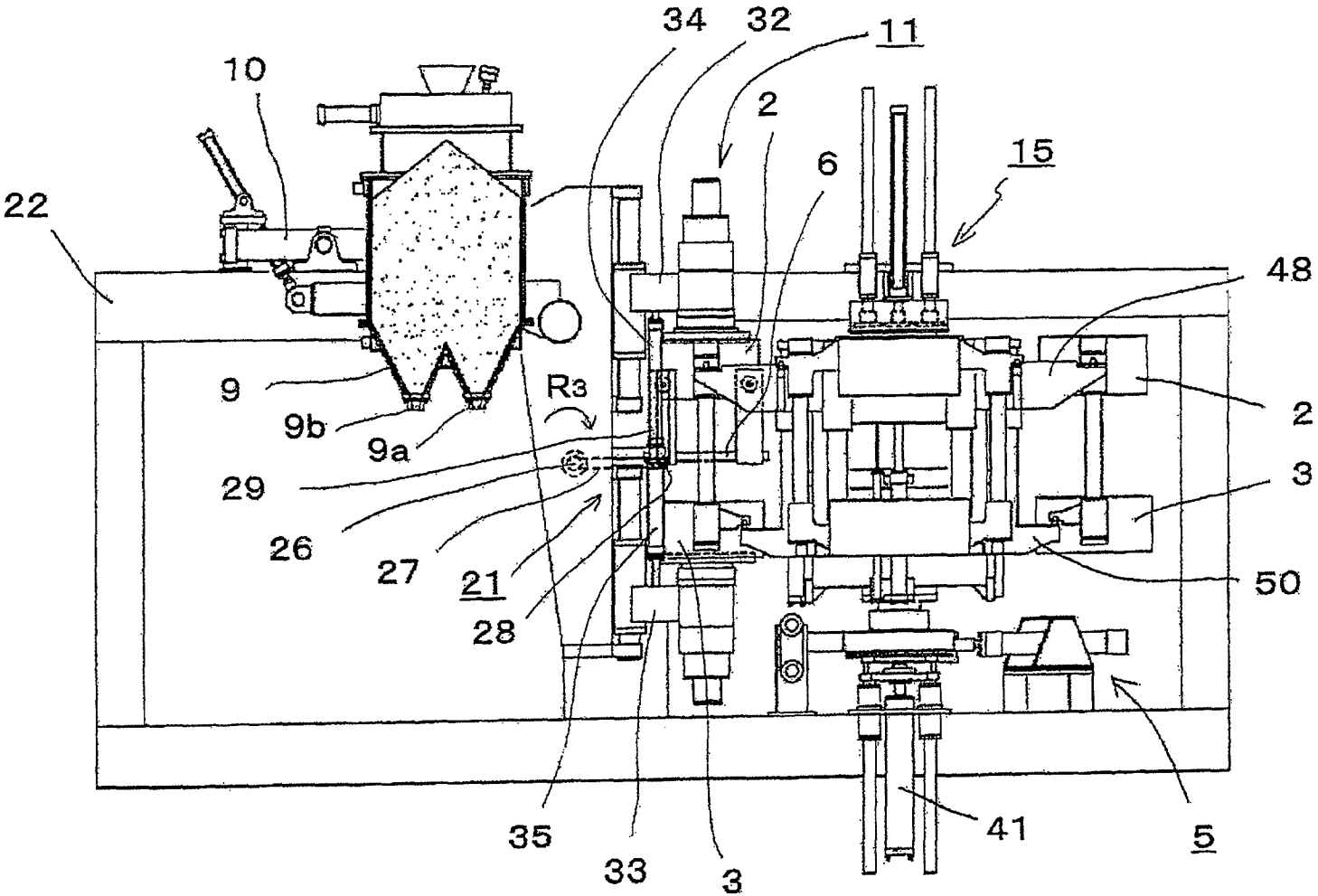
FIGS. 4 to 16 illustrate the successive front views during the operation of the molding machine in FIG. 1.

The rotary cylinder 26 of the device 21 for inserting and taking out the match plate is rotated from the position shown in FIG. 1. Thus, as shown in FIG. 4, the match plate 6 is inserted into the gap between the upper flask 2 and the lower flask 3 by a pair of the arms 27 that are moved around the axis in the direction R3. The upper flask 2 and the lower flask 3 horizontally face each other.

Next, the squeezing device 11 contracts the upward cylinder 34 and the lower cylinder 35 so as to move the upper flask 2 and the lower flask 3 to have them come close to each other by means of the upper elevating frame 32 and lower elevating frame 33. The upper and lower flasks 4 that were close to each other by means of the squeezing device 11 clamp the match plate 6. In this state, the squeezing device 11 elongates the cylinders 36, 37 by predetermined lengths. The cylinders 36, 37 insert the upper squeeze plate 7 and the lower squeeze plate 8 into the upper flask 2 and the lower flask 3, respectively. The upper squeeze plate 7 and the lower squeeze plate 8 form two vertically-arranged mold cavities (the upper mold cavity and the lower mold cavity) with the upper flask 2 and the lower flask 3 and the match plate 6, as shown in FIG. 5.

As shown in FIG. 6, the device 10 elongates the rod 10*a* to move the squeezing device 11 around the supporting shaft 23 in the direction R1. At this time, the device 10 directs the upper flask 2, the lower flask 3, and the match plate 6 to the vertical position. The ports 2*a*, 3*a* for introducing molding sand that are provided on the side walls of the upper flask 2 and the lower flask 3 are moved upwardly so as to be turned upward. Further, the ports 2*a*, 3*a* of the upper and lower flasks 4 contact the nozzles 9*a*, 9*b* for introducing molding sand. The nozzles 9*a*, 9*b* are shaped as two prongs at the bottom of the storage tank 9, which is an aeration tank. The operation that is described with reference to FIG. 6 may be performed at the same time as the formation of the mold cavities that is described with reference to FIG. 5.

Figure 8:
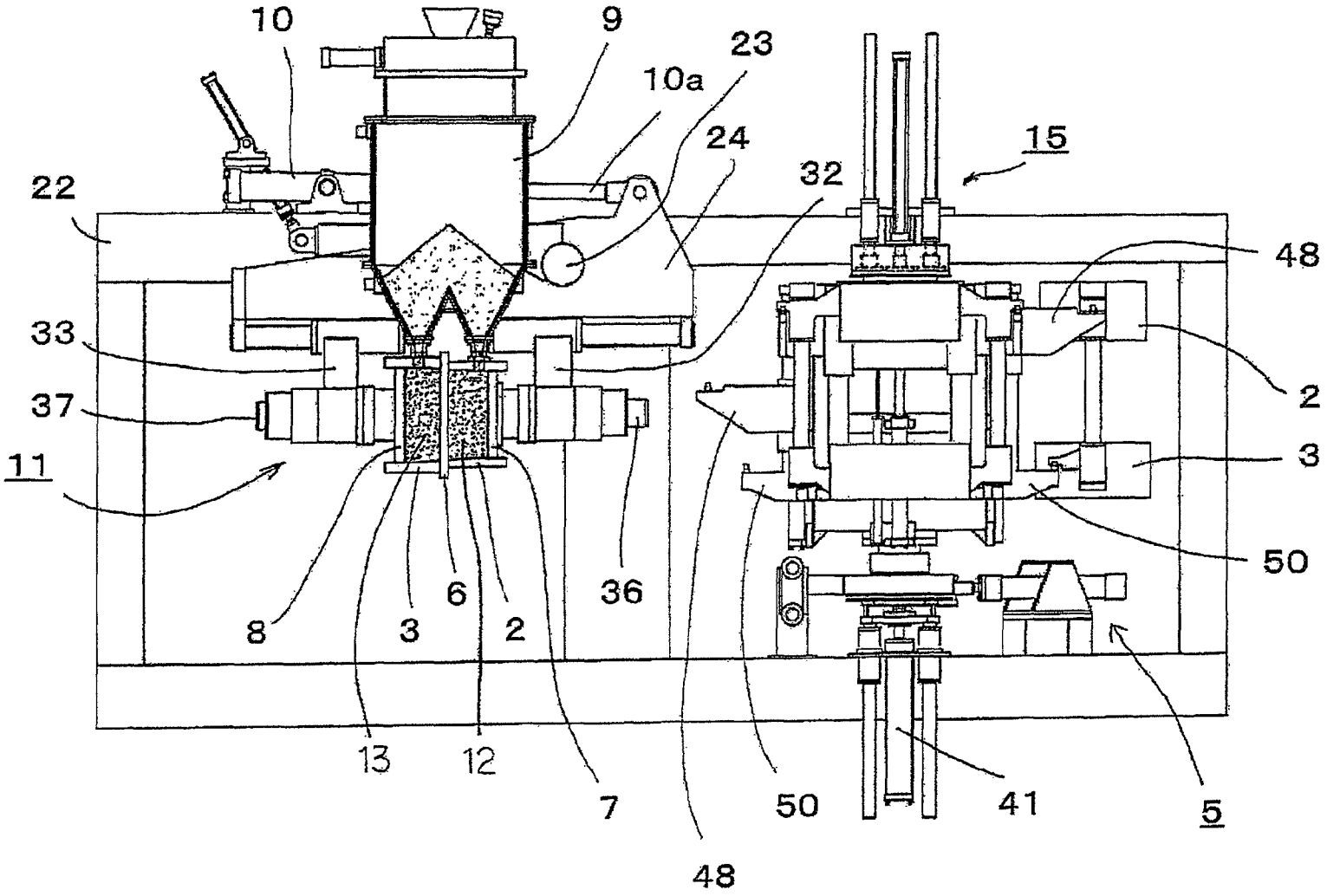

Next, as shown in FIG. 7, the storage tank 9 for sand, which functions as a device for filling the molding sand, fills the molding sand into the upper mold cavity and the lower mold cavity through the ports 2*a*, 3*a* for introducing the molding sand. Then, the cylinders 36, 37 are driven to move the upper squeeze plate 7 and the lower squeeze plate 8 toward the match plate 6, to thereby squeeze the molding sand. Then, the cylinders 36, 37 are contracted by predetermined lengths to move back the upper and lower squeeze plates 7, 8 to approximately the openings of the upper and lower flasks 4. Then, the storage tank 9 again fills the molding sand into the upper mold cavity and the lower mold cavity through the ports 2*a*, 3*a*. Then, as shown in FIG. 8, the cylinders 36, 37 elongate to move the upper squeeze plate 7 and the lower squeeze plate 8 toward the match plate 6. At this time, the upper squeeze plate 7 and the lower squeeze plate 8 squeeze the molding sand in the two mold cavities, i.e. the upper one and the lower one.

As discussed above, since the molding sand is filled in the mold cavities in two stages, the hardness of the molds near the openings of the upper and lower flasks 4 can be increased. The method comprises the steps of moving the squeeze plates backward after filling the molding sand and squeezing it, again filling the molding sand, and squeezing it so that the effect of more reliably filling the molding sand is achieved. However, the method is not limited to it. Filling the molding sand and squeezing it may also be done just once.

Figure 9:
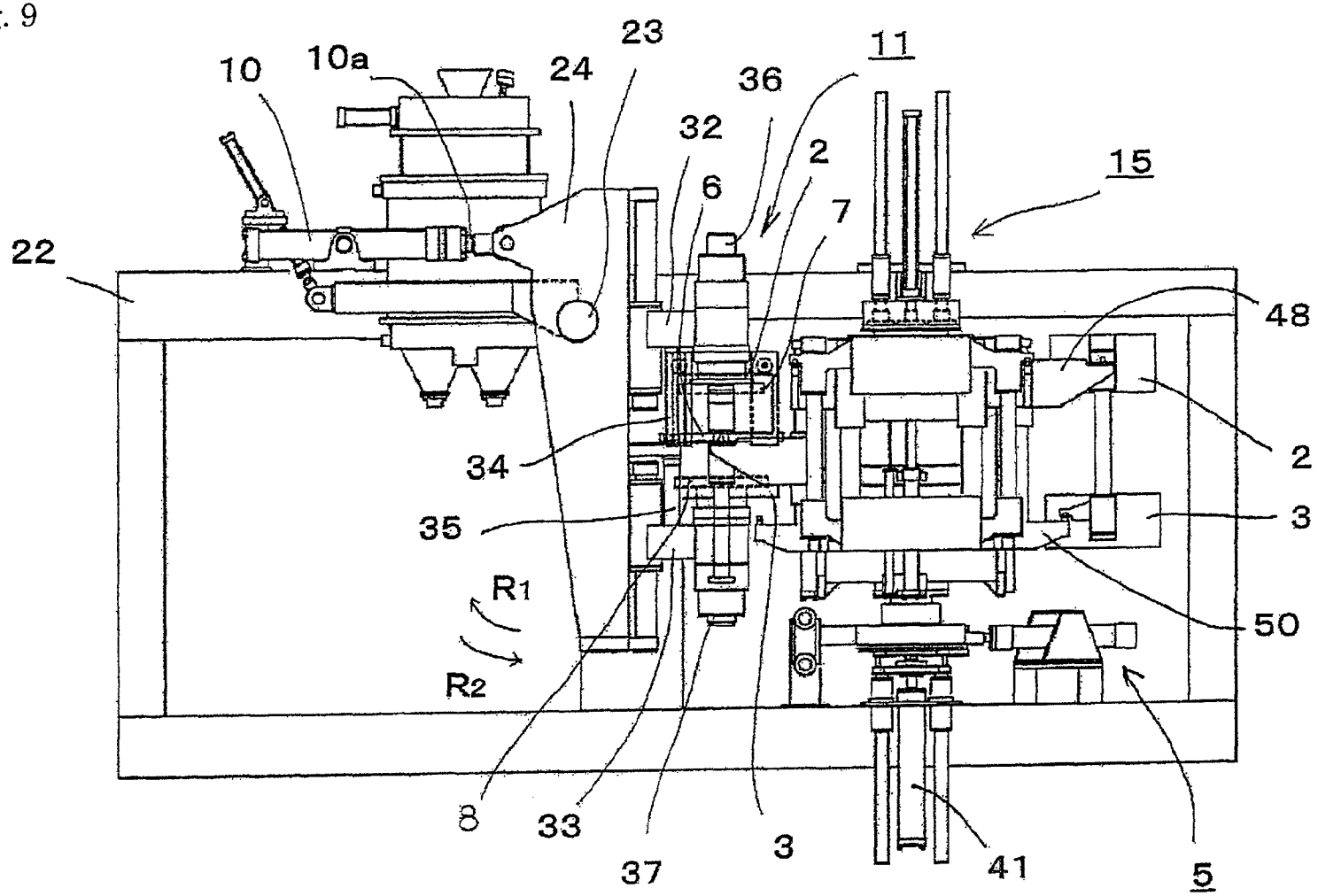

As shown in FIG. 9, the device 10 moves the upper flask 2, the lower flask 3, and the match plate 6 around the axis in the direction R2, which is reverse to the direction R1, so as to arrange them horizontally. The operation that is described with reference to FIG. 9 may be performed at the same time as the squeezing operation that is described with reference to FIG. 8.

Figure 10:
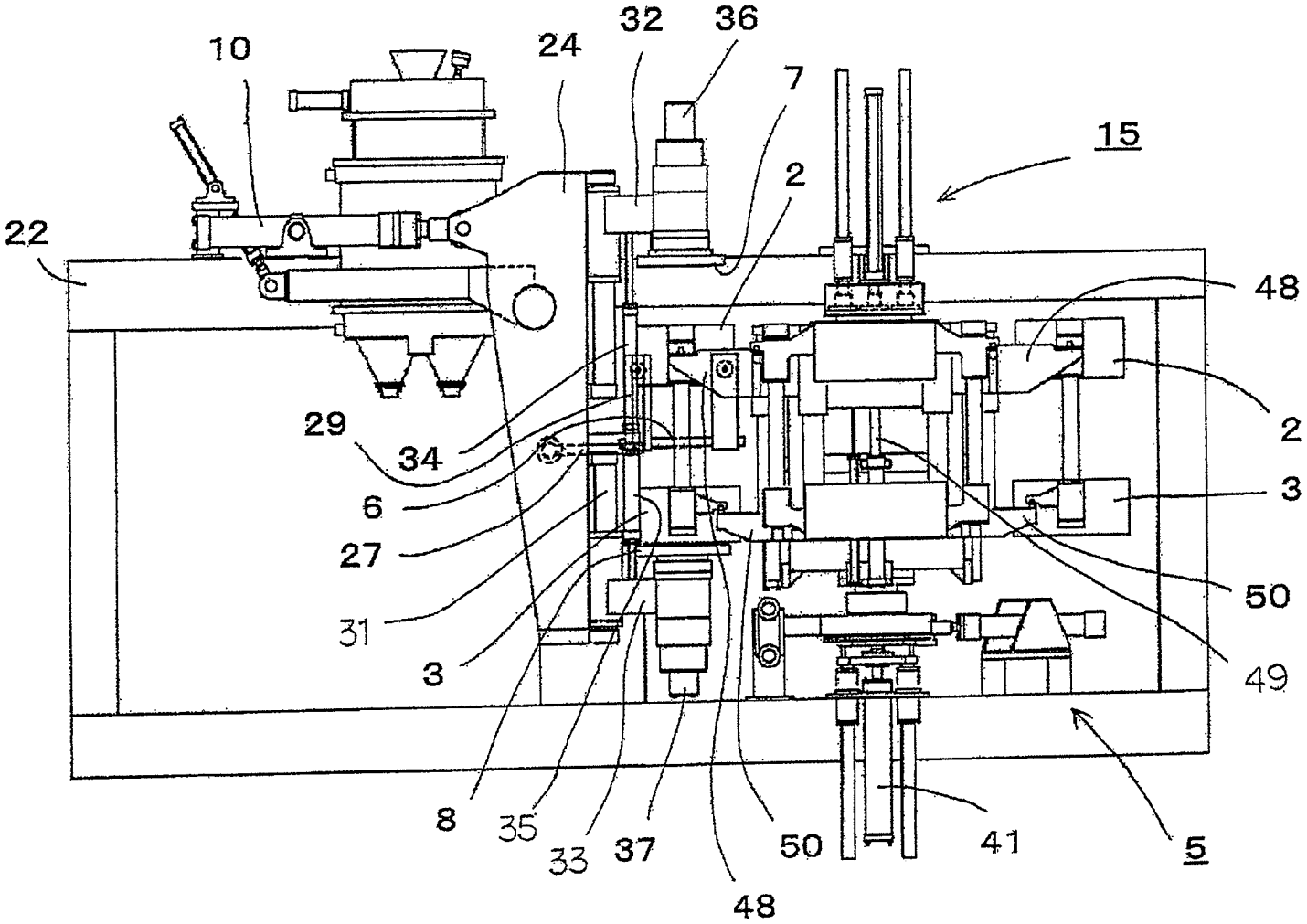

Next, the upward cylinder 34 and the downward cylinder 35 are elongated to retract the upper and lower elevating frames 32, 33 from each other. Then, as shown in FIG. 10, the device 5 for pivoting the flasks elongates the upward cylinder 49 to raise the upper flask 2 by the upper hooking members 48. The upper flask 2 contains the mold that was formed by squeezing the molding sand. By so doing this, the match plate 6 can be separated from the upper flask 2 and the lower flask 3. The cylinder 49 that is located at the pivoting part separates the upper flask 2 from the match plate 6. The lower flask 3 is mounted on the lower hooking member 50 of the device 5 by the cylinder 35, as shown in FIG. 10.

Figure 11:
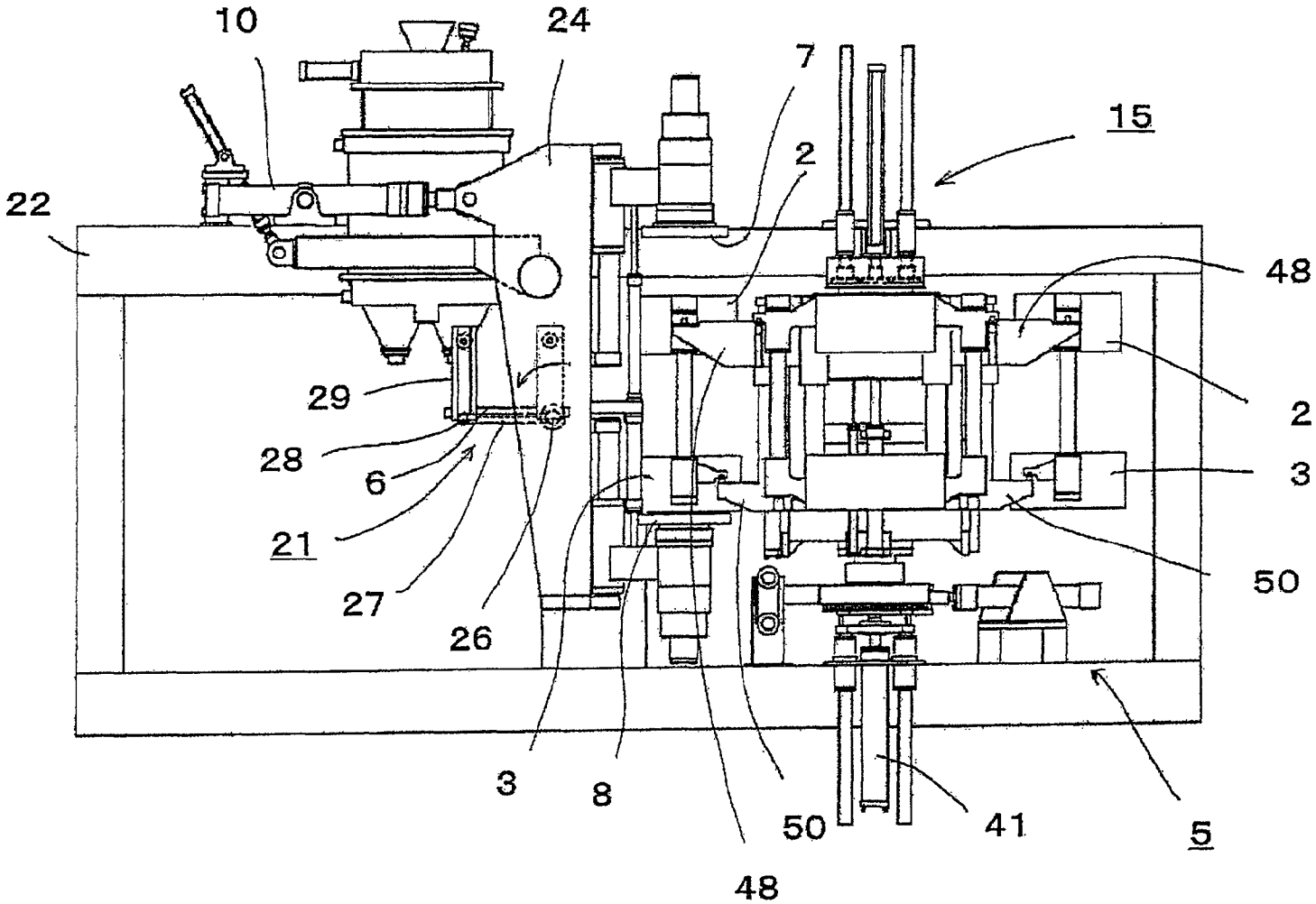

Next, as shown in FIG. 11, the rotary cylinder 26 rotates to carry the match plate 6 out of the gap between the upper flask 2 and the lower flask 3 by means of the pair of arms 27. Then, the device 5 for pivoting the flasks pivots the rotary shaft 42 by a predetermined angle to move the upper and lower flasks 4 from the molding station to the first station for placing a core. The upper and lower flasks 4 contain the molds. Thus, an operator can place a core in them. Then, the device 5 pivots the rotary shaft 42 by a predetermined angle to move the upper and lower flasks 4 from the first station for placing a core to the second station for placing a core. The upper and lower flasks 4 contain the molds. Thus, an operator can place another core in them.

Figure 12:
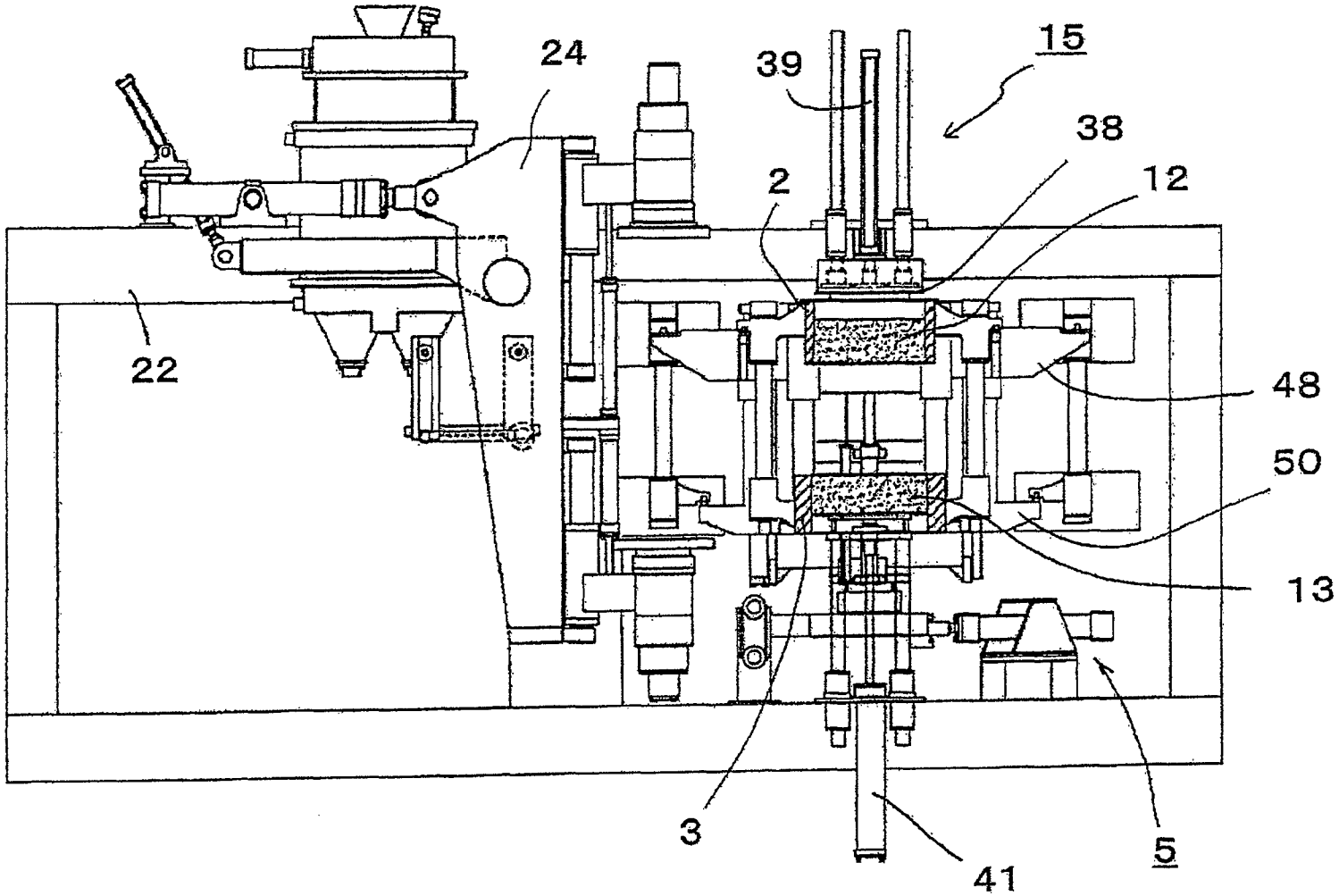

Then, as shown in FIG. 12, the device 5 for pivoting the flasks pivots the rotary shaft 42 by a predetermined angle to move the upper and lower flasks 4 that contain the molds to the station for extracting the molds where the device 15 for extracting molds is provided. The mold 12 shown in FIGS. 12-15 is the mold that is formed in the upper flask 2, and the mold 13 is the mold that is formed in the lower flask 3.

Figure 13:
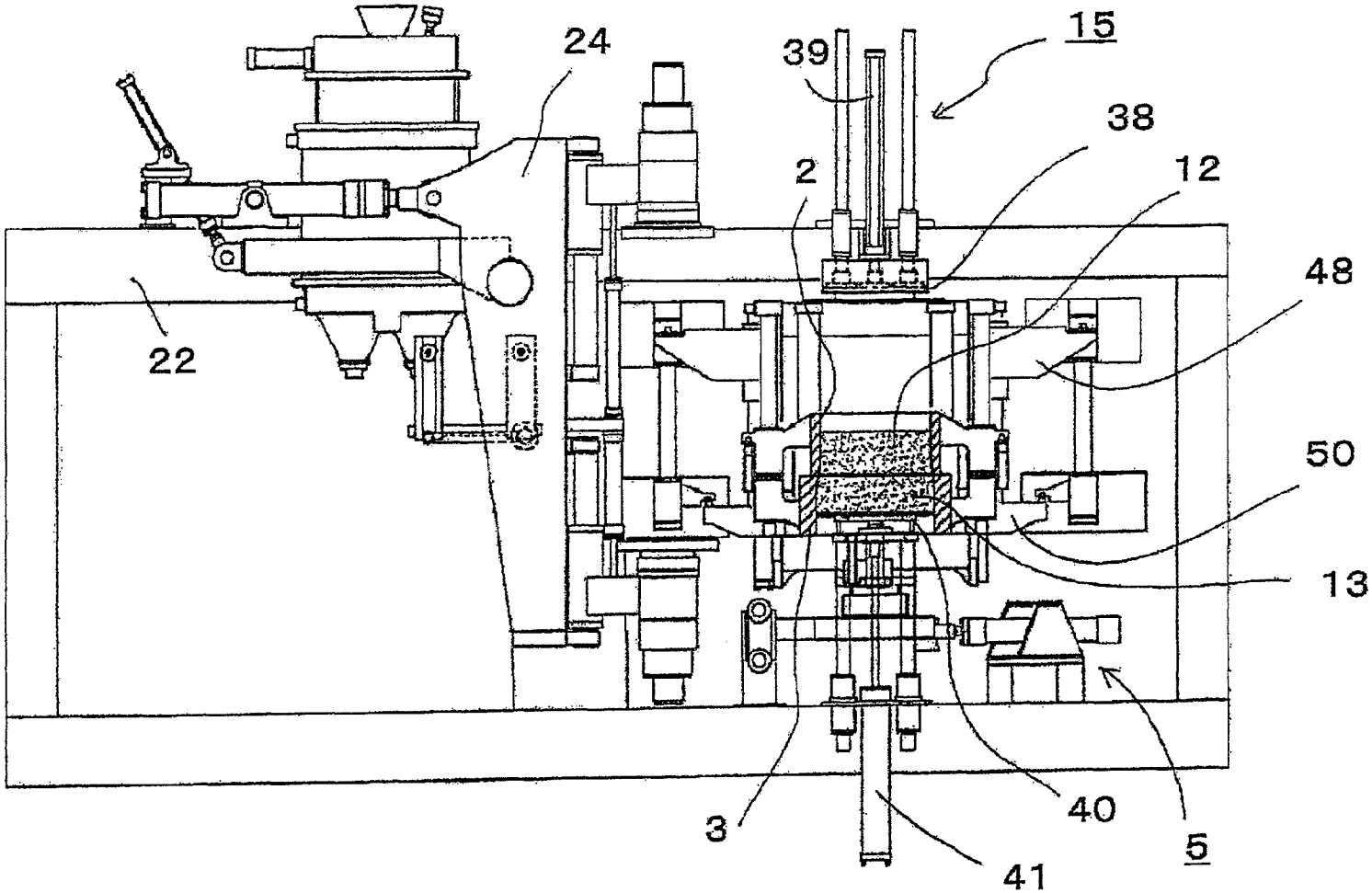

As shown in FIG. 13, the cylinder 49 contracts so as to lower the upper flask 2 having the mold in it by the hooking members 48 and to place it on the lower flask 3. Thus the upper and lower flasks are stacked.

Figure 14:
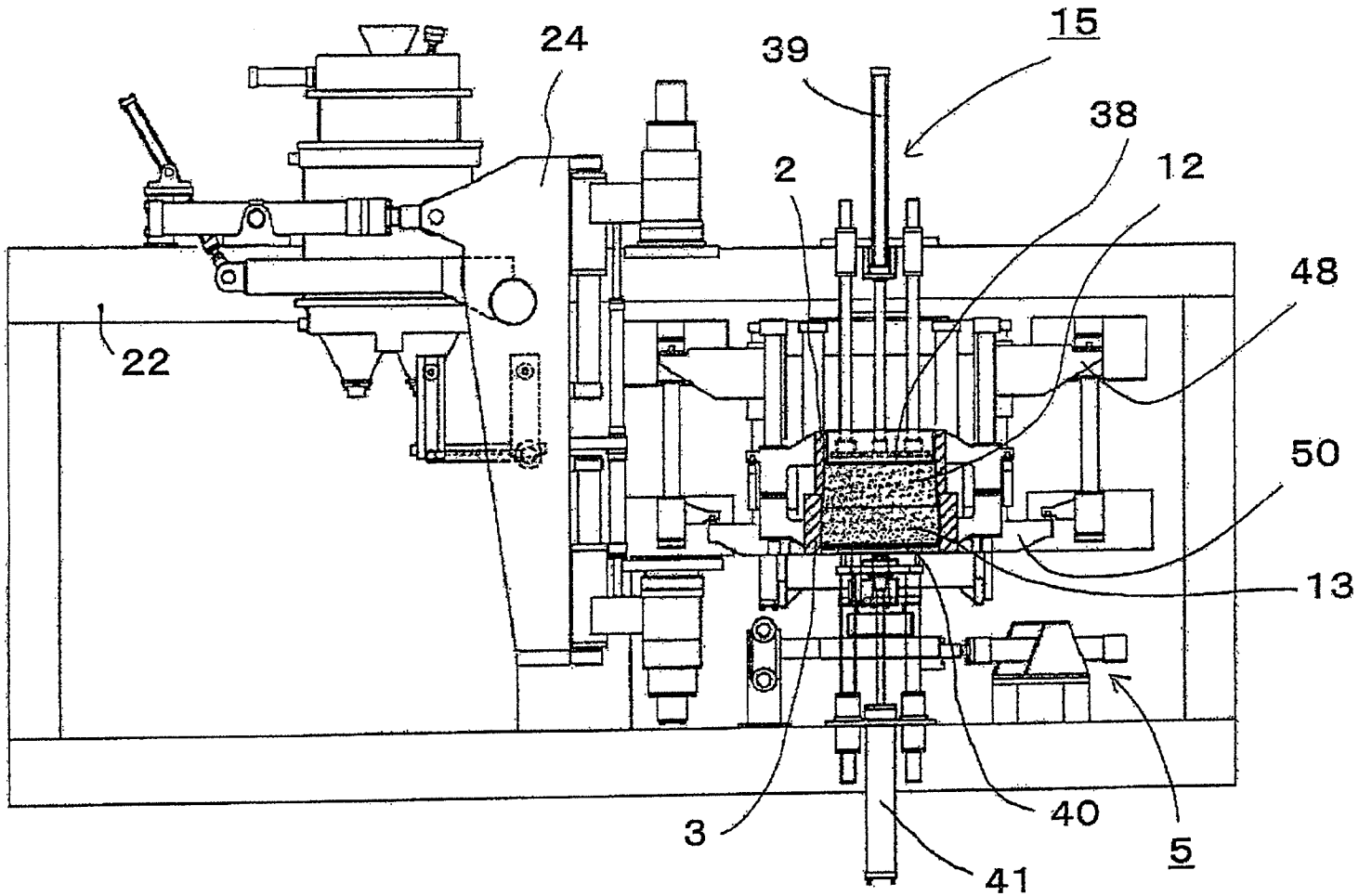
Figure 15:
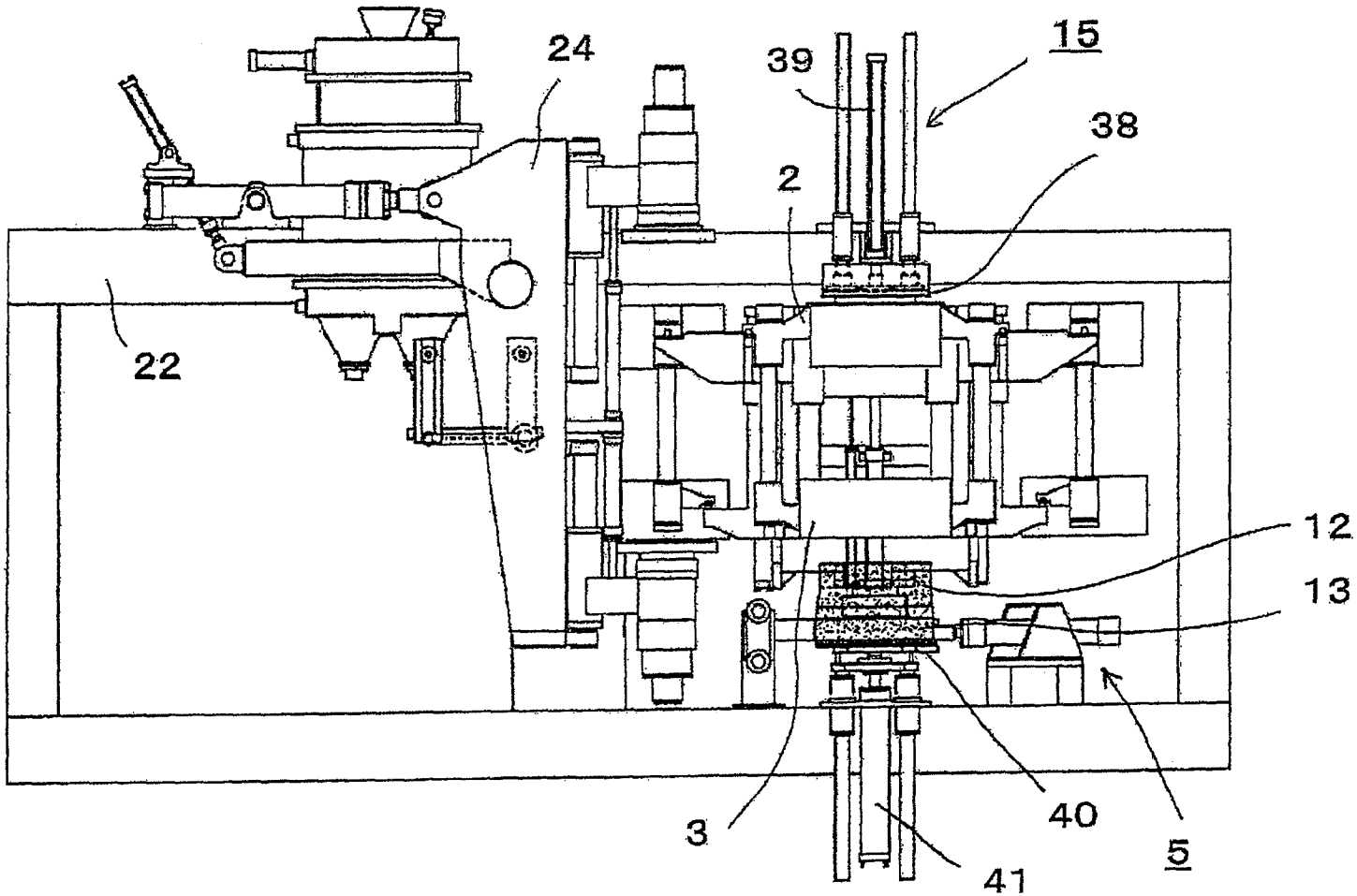
Figure 16:
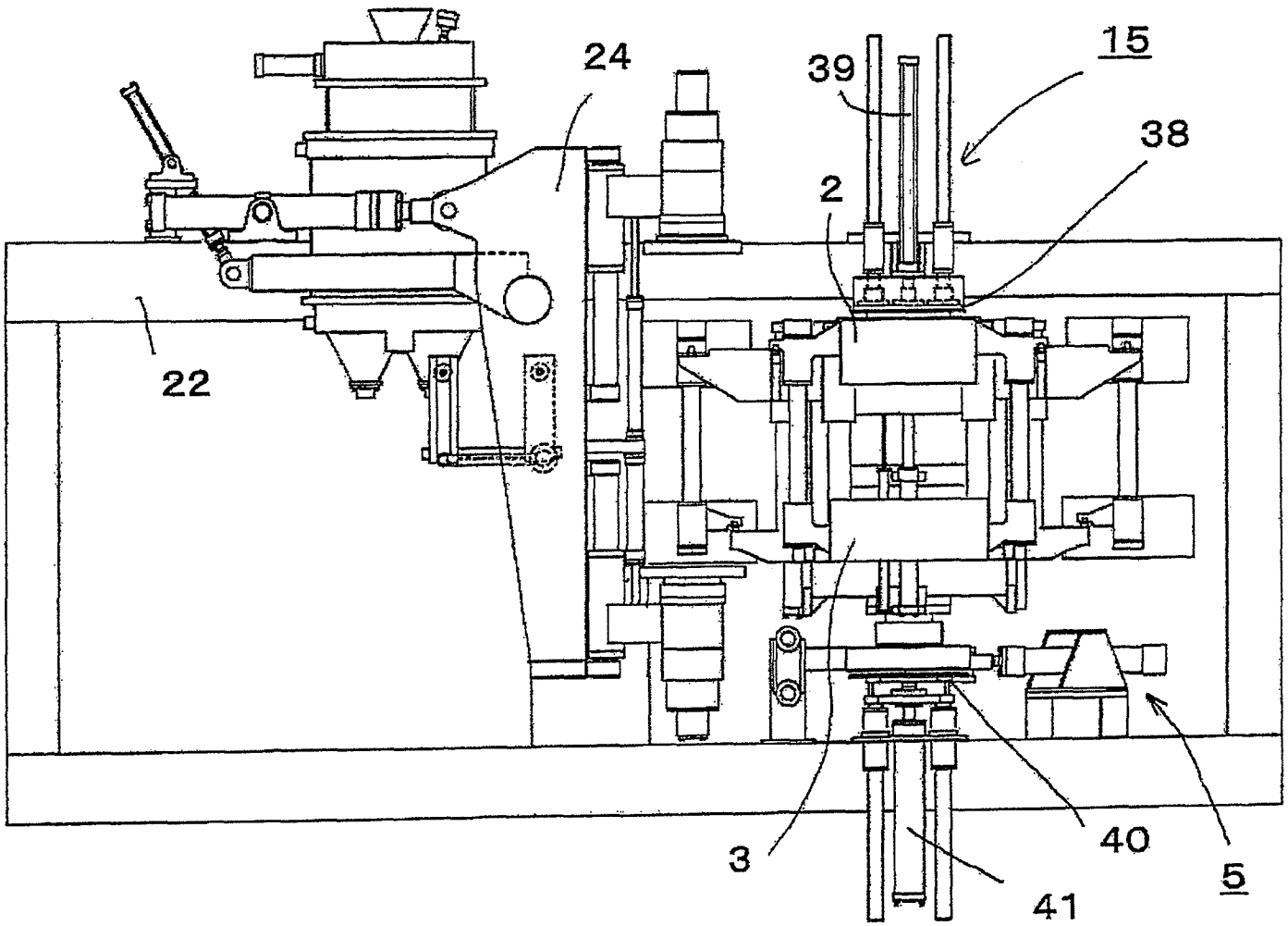

Next, the cylinder 41 of the device 15 for extracting molds is elongated so as to elevate the table 40 for receiving the molds. The upper and lower flasks 4 that contain the molds are mounted on the table 40. Then, as shown in FIGS. 14 and 15, the cylinder 39 of the device 15 is elongated to lower the pushing member 38 and the table 40 while they are coupled. Thus, the molds are extracted from the upper flask 2 and lower flask 3. Then, the upper and lower molds on the table 40 are pushed out by the device 51 for discharging the molds, as shown in FIG. 16.

The method comprises the steps of forming two mold cavities, i.e., upper and lower ones, by inserting the upper and lower squeeze plates 7, 8 into the upper flask 2 and the lower flask 3 that are located at the molding station, filling the molding sand into the cavities, and then moving the upper and lower squeeze plates 7, 8 backward by predetermined distances. The present invention is not limited to it. That is, the upper and lower squeeze plates 7, 8 may be moved backward by predetermined distances while the molding sand is being filled into the two mold cavities that are formed by inserting the upper and lower squeeze plates 7, 8 into the upper flask 2 and the lower flask 3, respectively.

As a means for squeezing the molding sand, the single upper squeeze plate 7 and the single lower squeeze plate 8 are used. The present invention is not limited to that configuration. A plurality of upper and lower squeeze feet may be used. The squeeze feet have a form that is made by a plurality of pieces that are made by dividing the squeeze plate. They may be moved forward and backward by a plurality of hydraulic cylinders.

The molding method that is discussed above is characterized in that it has these steps (1) to (12). That is, in step (1), the match plate 6 is clamped by moving the upper and lower flasks 4 to have them come close to each other, wherein the upper and lower flasks 4 consist of the upper flask 2 and the lower flask 3 and vertically face each other. In step (2), the pair of squeeze plates 7, 8 are inserted through the openings 2*a*, 2*b* of the upper and lower flasks 4 to form the upper mold cavity and the lower mold cavity. In step (3), the upper and lower flasks 4 that form the upper and lower cavities in them are moved around a horizontal axis to position the ports 2*a*, 3*a* for introducing molding sand so that the molding sand can be filled from the pair of nozzles 9*a*, 9*b* for introducing molding sand that are formed downwardly from the bottom of the storage tank 9 for sand. In step (4), the molding sand is filled from the storage tank 9 into the upper mold cavity and the lower mold cavity through the ports 2*a*, 3*a*. In step (5), the pair of squeeze plates are moved toward the match plate 6, to thereby squeeze the molding sand in the upper mold cavity and the lower mold cavity. In step (6), the upper and lower flasks 4 are moved around the axis and back to the position where they vertically face each other. In step (7), the match plate 6 is separated from the molds that are formed in the upper and lower flasks 4 by moving the upper and lower flasks 4 to have them retract from each other. In step (8), the upper and lower flasks 4 are pivoted by the device 5 for pivoting the flasks so as to move the upper and lower flasks 4, in which the molds are formed, to the first station for placing a core, and thereby a core can be placed. In step (9), the upper and lower flasks 4 are further pivoted in the same direction so as to move them to the second station for placing a core so that a core can be placed. In step (10), the upper and lower flasks 4 are further pivoted in the same direction so as to move them to the station for extracting the molds. In step (11), the upper and lower flasks having the molds in them are stacked by moving them to have them come close to each other after they have passed the first and second stations for placing a core. In step (12), the upper and lower molds are extracted from the upper and lower flasks by the device 15 for extracting molds, which device 15 has a member that goes into the upper and lower flasks that are stacked, while the upper and lower molds are stacked. In this method, four pairs of the upper and lower flasks, each of which consists of an upper flask and a lower flask, are provided in the states that are suitable for the operations at four stations, including the molding station, the first station for placing a core, the second station for placing a core, and the station for extracting the molds. By moving the upper and lower flasks via the four stations, the flaskless molds that are stacked are formed successively.

Since the molding method of the present invention comprises that characteristic feature, a long period relative to the cycle time can be designated to place cores, to thereby meet the needs for efficient molding. That is, the present invention achieves efficient molding where the cycle time is shortened even if many cores are placed.

It has a feature wherein, in steps (8) and (9), a core is placed in the molds that have been formed in steps (1) to (7) while steps (1) to (7) are being performed. Thus efficient molding is achieved.

The molding method that uses the molding machine 1 may be configured to include step (13) after step (12). In step (13), the upper and lower flasks are further moved around the axis in the same direction after the molds are extracted to move them to the molding station. To enable the movements around the axis in one direction in steps (8), (9), (10), and (13) to be continuous, the air-supply tube and hydraulic tube are connected to the respective air-supplying tube and hydraulic tube in the rotary portion of the device 5 for pivoting the flasks, which rotates via the revolute joint 16. This characteristic molding method enables the air-supplying tube and hydraulic tube that are provided in a rotary portion to rotate in one direction without causing trouble due to the continual rotation of the device 5 in one direction, to thereby achieve efficient molding. That is, an efficient molding method that utilizes the four stations is achieved. Thus, an efficient molding method, by which the cycle time is shortened even if many cores are placed, is achieved.

In step (3) in the molding method that utilizes the molding machine 1, the ports 2*a*, 3*a* for introducing molding sand may receive the molding sand from the pair of nozzles 9*a*, 9*b* by moving the upper and lower flasks 4 around the axis from the position where they vertically face each other to the position where they horizontally face each other. Since the molding sand is downwardly filled, an efficient filling of the molding sand is achieved.

In step (3) in the molding method that utilizes the molding machine 1, the ports 2*a*, 3*a* for introducing molding sand may receive the molding sand from the pair of nozzles 9*a*, 9*b* by moving the upper and lower flasks 4 around the axis from the position where they vertically face each other to the position that is before the position where they horizontally face each other and by moving the storage tank 9 for sand in the direction that is reverse to the direction of the movement of the upper and lower flasks 4. This method is a good one to form molds that are used to manufacture a cast that has a complicated shape, such as a sleeve, as discussed above.

Further, the molding method that utilizes the molding machine 1 may combine the steps of filling the molding sand in the horizontal position and in the oblique position. That is, before step (3), a step is added to select the position for filling the molding sand based on the pattern that is placed on the match plate. This selection is done by the controller 18, as discussed above. Specifically, it may be done during step (1) or (2). In step (3), if the selected position is the first position, the upper and lower flasks are moved around the axis from the position where they vertically face each other to the position where they horizontally face each other so that the ports for introducing molding sand can receive the molding sand from the pair of nozzles for introducing molding sand. In step (3), if the selected position is the second position, the upper and lower flasks are moved around the axis from the position where they vertically face each other to the oblique position, which position is before the position where they horizontally face each other, and the storage tank is moved around the axis in the direction reverse to that of the upper and lower flasks, so that the ports for introducing molding sand can receive the molding sand from the pair of nozzles for introducing molding sand. This characteristic molding method is suitable for forming molds that have complicated shapes. In addition, it may be used to continuously form molds that have relatively simple shapes and molds that have complicated shapes.

As discussed above, the molding machine 1 of the present invention is characterized in that it comprises four pairs of the upper and lower flasks 4, each of which has the upper flask 2 and the lower flask 3, the device 5 for pivoting the flasks, the match plate 6, the pair of squeeze plates 7, 8, the storage tank 9 for sand, the device 10 for moving forward and backward around the axis, the squeezing device 11, the device 14 for moving the upper and lower flasks, and the device 15 for extracting molds. By the molding machine 1, the upper and lower flasks are pivoted through the four stations so that molding, placing cores, and extracting the molds are efficiently done. That is, by the molding machine 1, since two stations for placing a core are provided, the cores are placed in two stages. Thus the cycle time is prevented from being long. As can be seen, the molding machine 1 and the molding method that utilizes it are characterized in that four stations are provided. However, the present invention is not limited to a molding machine having four stations. It is also applicable to a molding machine that has five or more stations, such as five stations or six stations.

The device 17 for moving the storage tank forward and backward around the axis may be added to the molding machine 1 of the present invention. By doing so, aeration filling directed to the molding sand in the oblique position can be performed. Thus, a pattern that makes it difficult to fill mold cavities with the molding sand by means of a conventional molding machine can be used, and thereby the molding sand is well filled in the flasks.

Next, the molding machine 201 of the present invention as a variation of the molding machine 1 and the molding method that utilizes the molding machine are described with reference to FIGS. 30 to 38. This molding machine 201 and the molding method meet the need for more efficient molding. Further, they meet the need for forming gas vents in a flaskless molding machine or method so as to prevent a defect in a cast from being generated due to imperfect venting. That is, the molding machine 201 and method achieve efficient molding by shortening the cycle time even if many cores are placed and by forming gas vents. Below, they are described.

The molding machine 201 has the same construction as that of the molding machine 1, except a hole-forming device 80 is added. Thus, the same numbers or symbols are used for similar elements and the descriptions of them are omitted. The hole-forming device 80 is described below. The molding machine 201 has additional effects because the hole-forming device is added. The effects are described below. The molding machine 201, which has the same components as those of the molding machine 1, has the same effects as those of the molding machine 1. These effects, which have been described, are omitted here.

Figure 30:
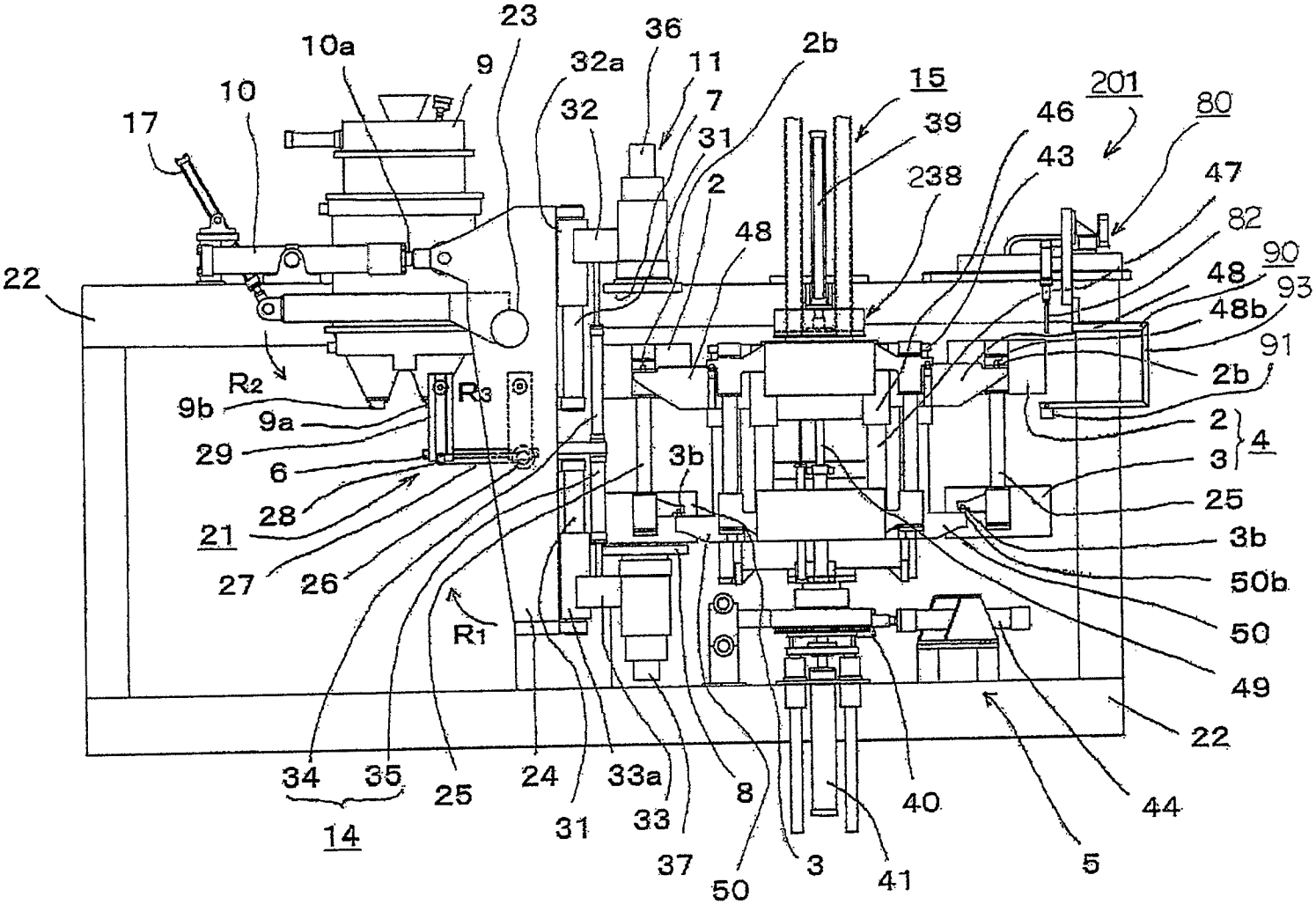
FIG. 30 is a front view of another embodiment of the molding machine of the present invention, which includes a hole-forming device.
Figure 31:
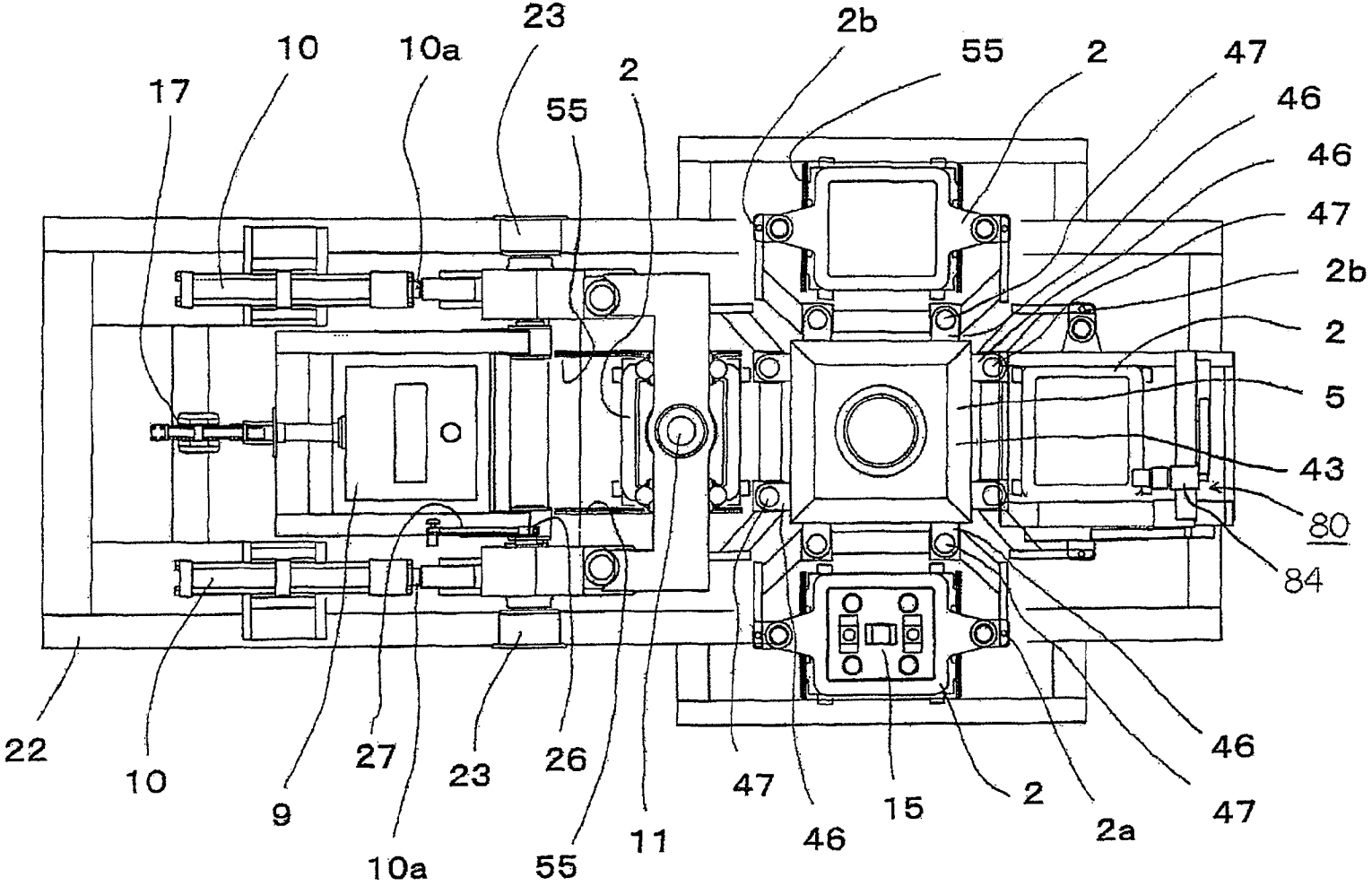
FIG. 31 is a plan view of the molding machine in FIG. 30.
Figure 32:
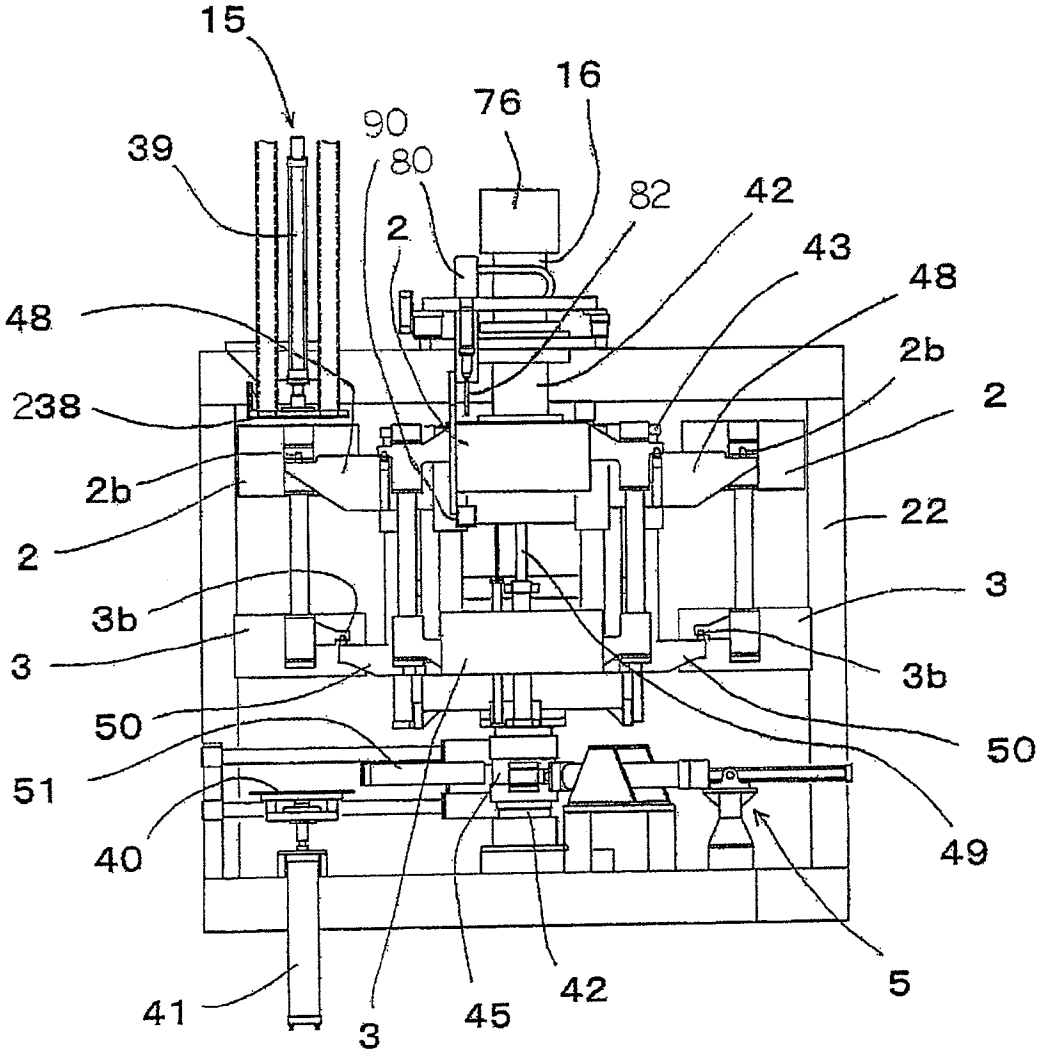
FIG. 32 is a side view of the molding machine in FIG. 30.
Figure 33:
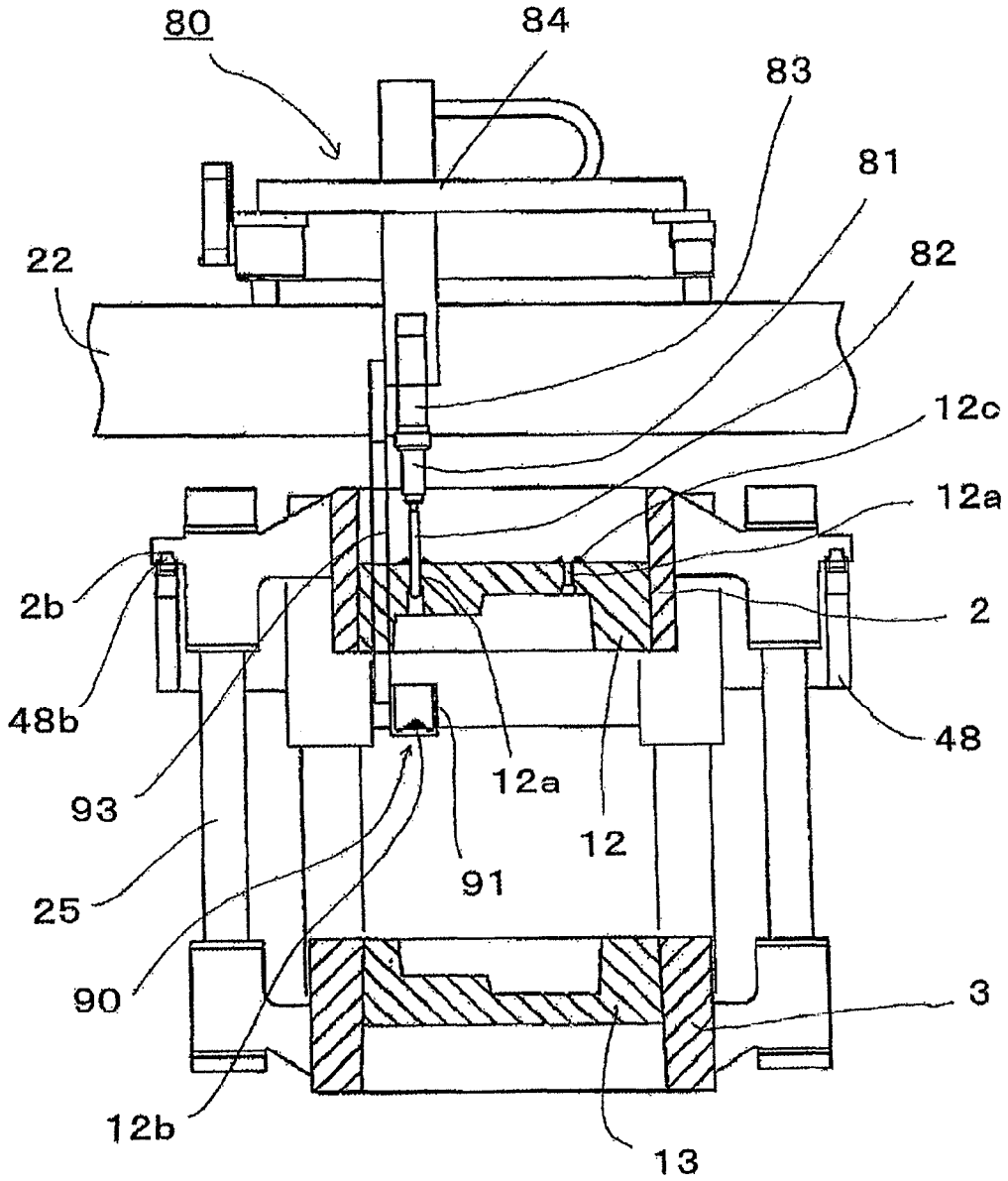
FIG. 33 is a side and enlarged view of the molding machine in FIG. 30, which illustrates the hole-forming device.
Figure 34:
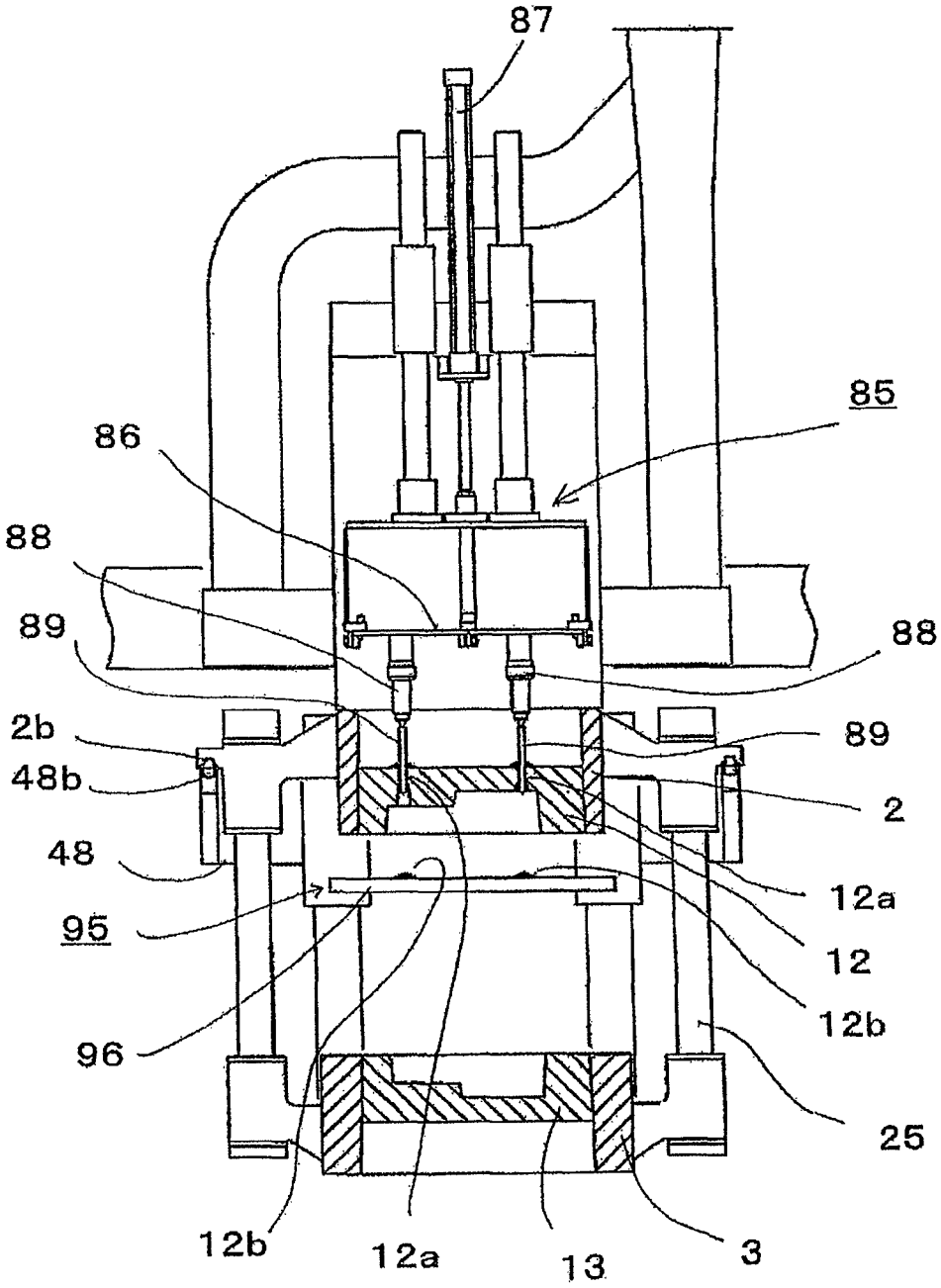
FIG. 34 is a front view of the molding machine in FIG. 30, which illustrates another embodiment of the hole-forming device.

As shown in FIGS. 30, 31, and 32, the molding machine 201 comprises four pairs of the upper and lower flasks 4, each of which has an upper flask 2 and a lower flask 3, a device 5 for pivoting the flasks, a match plate 6, a pair of squeeze plates 7, 8, a storage tank 9 for sand, a device 10 for moving forward and backward around an axis, a squeezing device 11, a device 14 for moving the upper and lower flasks, a device 15 for extracting the molds, and the hole-forming device 80.

The hole-forming device 80 is disposed in a first or second station for placing a core. It forms one or more holes 12*a* for venting gas (also called "gas vents") in a mold 12 in the upper flask 2 of the upper and lower flasks 4 that have been moved to the station. About the molding machine 201 to be described below, the hole-forming device 80 is disposed in the second station for placing a core. However, it may be disposed in the first station for placing a core.

As shown in FIGS. 30-33 for example, the hole-forming device 80 has a drill 82 that is rotated by a rotary driver 81 that is an air-type, and first and second actuators 83, 84 that move the drill 82 in x- and y-directions that perpendicularly intersect each other on a horizontal plane and in a z-direction that is vertical. The rotary driver 81 is described as an air-type driver, for example, but it may be an electric-type or hydraulic-type driver. The drill is a member that has spiral cutting edges and undercuts on a steel round bar.

The first actuator 83 moves the drill 82 vertically in the z-direction. It is, for example, a cylinder, of which the rod is integrated with the drill 82 so that the elongation and contraction of the rod moves the drill 82. The second actuator 84 moves the first actuator 83 that holds the drill 82 in both the x- and y-directions. It may comprise, for example, two cylinders or feed screws that are disposed to elongate their respective rods in different directions, or a combination of them. The actuators of the hole-forming device 80 are not limited to the first and second actuators 83, 84. For example, they may be replaced by a multi-joint robot that moves the drill 82 in the x-, y-, and z-directions.

By the hole-forming device 80, the drill 82 that is moved by the first and second actuators 83, 84 may, for example, form four gas vents 12*a* in the mold 12 in the upper flask 2. The number of gas vents is not limited to four.

In the molding machine 201, a device 90 for discharging the sand is provided in the station (the second station for placing a core in this embodiment) where the hole-forming device 80 is provided. The device 90 for discharging the sand has a member 91 for receiving sand that is inserted under the upper flask 2 in the station (the second station for placing a core) when the hole-forming device 80 forms a hole. The member 91 receives the sand 12 that is generated by forming a hole. The device 90 has a transporting device (not shown) that inserts the member 91 for receiving sand under the upper flask 2 and takes it out (extracts) from there. Since the device 90 for discharging the sand takes out the member 91 for receiving sand from the position under the upper flask 2 after a hole is formed, the sand generated by forming the hole is discharged.

Specifically, the member 91 for receiving sand is formed like a cup. It is integrated with the second actuator 84, which is a device for moving it, by an arm 93 that skirts the flask. It is moved by the second actuator 84 in the x- and y-directions to follow the movement of the drill 82 in x- and y-directions. Thus it moves together with the drill 82. The cup-like shape means a shape that has a basal plane in the shape of a circle, a rectangle, etc., and a side in the shape of a cylinder, a cone, a prism, a pyramid, etc.

The device 90 for discharging the sand has, for example, a rotary driver that rotates the member 91 for receiving sand upside down when it moves back to the original position and a container for collecting the sand 12*b* that is discharged from the member 91 that is rotated upside down. The device 90 for discharging the sand may have a vacuum device (not shown) to suction the sand that was discharged by the member 91 for receiving sand. Alternatively, the vacuum device may be directly connected to the cup-like member 91 for receiving sand so as to collect the sand 12*b* by suctioning it when forming a hole is completed or while a hole is being formed.

As discussed above, the device 90 for discharging the sand prevents unwanted sand that is generated by forming a hole from being deposited on the mold or core within the lower flask 3, to thereby prevent a defect in a cast.

The hole-forming device, which is a part of the molding machine 201, is not limited to the hole-forming device 80 in FIGS. 30-33. It may be the hole-forming device 85 in FIG. 34. The hole-forming device 85 has a board 86 that is a plate having a horizontal plane, an actuator 87 for vertically moving the board 86, and one or more drills 89 that are detachably attached to the lower surface of the board 86 and rotated by an air-type driver 88. The rotary driver 88 may be an electric-type or hydraulic-type one. For example, four drills 89 are provided so as to form gas vents 12*a* at the corresponding positions on the horizontal plane. For example, the drills 89 can be manually moved in the horizontal plane when the match plate is replaced (the replacement of the pattern). The hole-forming device 85 forms the same number of gas vents 12*a* as that of the drills 89 by a plurality of drills 89 at one time in the mold 12 within the upper flask 2. Since the hole-forming device 85 forms a plurality of gas vents at one time, the cycle time is shortened, to thereby achieve more efficient molding.

A device 95 for discharging the sand is provided in the station (the second station for placing a core in this embodiment), where the hole-forming device 85 is provided. The device 95 for discharging the sand has a member 91 for receiving sand 12 that is inserted under the upper flask 2 in the station (the second station for placing a core) when the hole-forming device 85 forms holes and receives the sand that is generated by forming holes, and a transporting device (not shown) that inserts the member 96 for receiving sand under the upper flask 2 and takes it out (extracts) from there. Since the device 95 for discharging the sand takes out the member 96 for receiving sand from the position under the upper flask 2 after holes are formed, the sand generated by forming the holes is discharged.

Specifically, the member 96 for receiving sand is a plate that has a wider area in a horizontal plane than that of the upper flask 2. The device 95 for discharging the sand has a rotary driver that inclines, or turns upside down, the member 96 for receiving sand when it moves back to the original position, and has a container for collecting the sand 12*b* that is discharged from the inclined or upside-down member 96 for receiving sand. The device 96 for discharging the sand may have a vacuum device (not shown) to suction the sand that was discharged by the member 96 for receiving sand. Alternatively, a hood may be provided around the member 96 for receiving sand so as to collect the sand 12*b* by suctioning it when forming holes is completed or while holes are being formed.

As discussed above, the device 95 for discharging the sand prevents unwanted sand that is generated by forming holes from being deposited on the mold or core within the lower flask 3, to thereby prevent a defect in a cast. The device 95 for discharging sand may be used for the hole-forming device 80.

The hole-forming device 80, 85 and the device 90, 95 for discharging the sand have good effects when used for the molding machine 201, which has two stations for placing a core. As discussed above and below, the molding machine 201 shortens the cycle time so as to achieve more efficient molding, because it has four stations. By providing a hole-forming device and a device for discharging sand in either the first or second station for placing a core, gas vents are automatically formed without making the cycle time longer, to thereby prevent a defect in a cast due to imperfect venting. In other words, a hole-forming device (the hole-forming devices 80, 85), which cannot be installed in a so-called two-station flaskless molding machine, is provided without making the construction of the molding machine complicated, and thereby forming gas vents.

The hole-forming device 80, 85 is characterized in that one or more holes are formed in the mold within the upper flask 2 that is positioned in the station where the hole-forming device is provided (herein, the second station for placing a core) while the rotary frame 43 is locked by the device 58 for locking the position. When gas vents 12*a* are formed in the mold within the upper and lower flasks 4, since the upper and lower flasks 4 are securely locked by the device 58 for locking the position, vents are reliably and well formed, to thereby prevent any defect from occurring in a cast due to imperfect venting.

In the device 15 for extracting molds of the molding machine 201, a pushing member 238 is provided instead of the pushing member 38. The device 15 for extracting molds of the molding machine 201 has the pushing member 238. It can enter from above the upper and lower flasks that are vertically stacked and horizontally placed, so as to push downwardly the upper and lower molds in the upper and lower flasks 4. The pushing member 238 is the same as the pushing member 38 in being fixed to the bottom of the piston rod of the downward cylinder 39 that is attached to the top portion of the platform 22 and in vertically moving by the elongation and contraction of the cylinder 39. The table 40 and the cylinder 41 are also provided like in the molding machine 1.

The pushing member 238 not only extracts the molds, but also discharges the sand that is left in the mold when a hole is formed by the hole-forming device 80, 85. Specifically, as in FIGS. 35-38, the pushing member 238 comprises an opening 100 for suctioning sand on the mold, a suction pipe 101 that forms the opening 100 and functions as a route for suctioning sand, and a means 102 for suctioning sand, such as a suction pump, that is connected to the opening 100 through the suction pipe 101. A flexible tube 103, such as a rubber hose, is used to connect the suction pipe 101 to the means 102 for suctioning sand.

Figure 35:
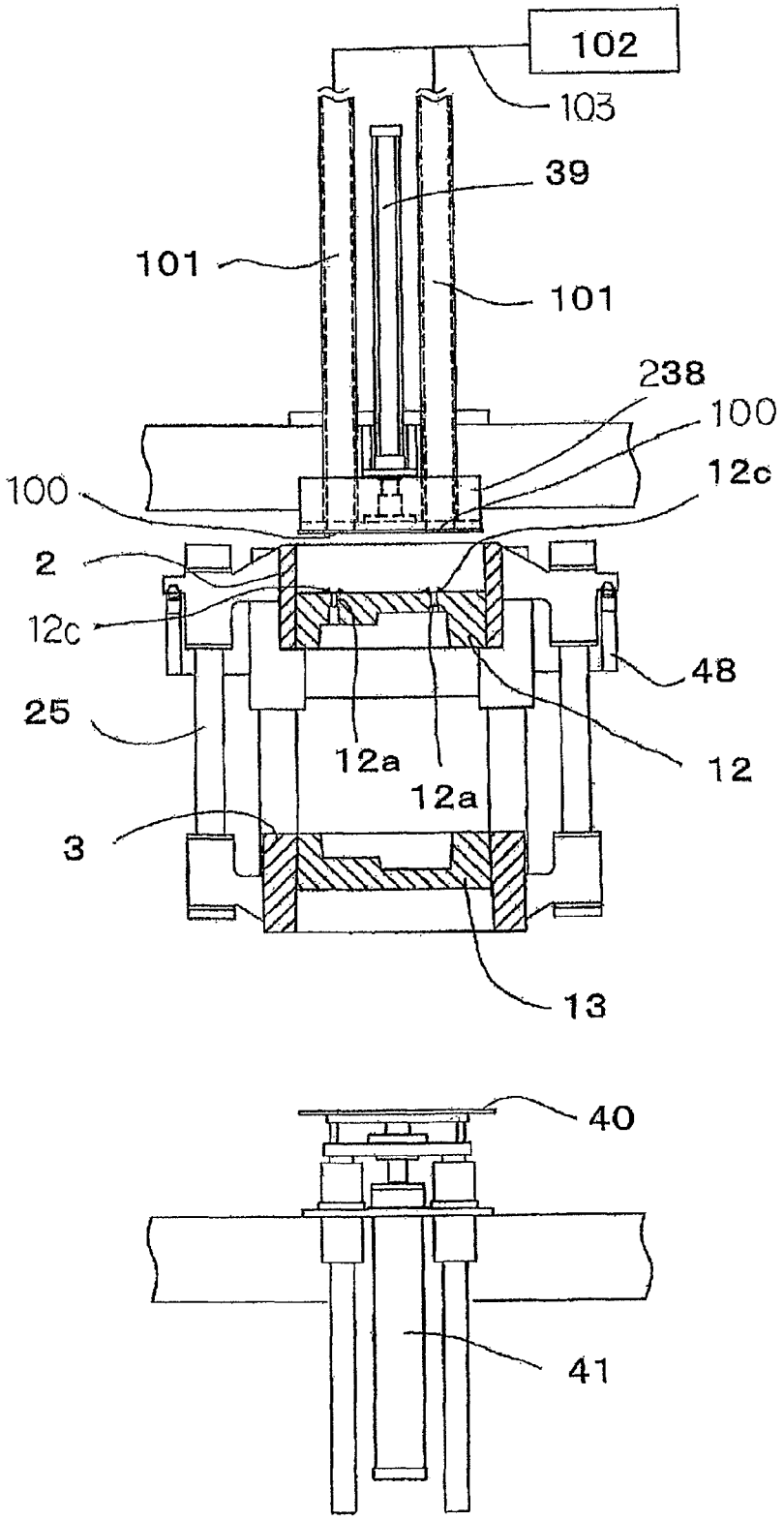
FIGS. 35 to 38 illustrate that the pushing member has an ability to suction sand on the molds in the molding machine in FIG. 30.
Figure 36:
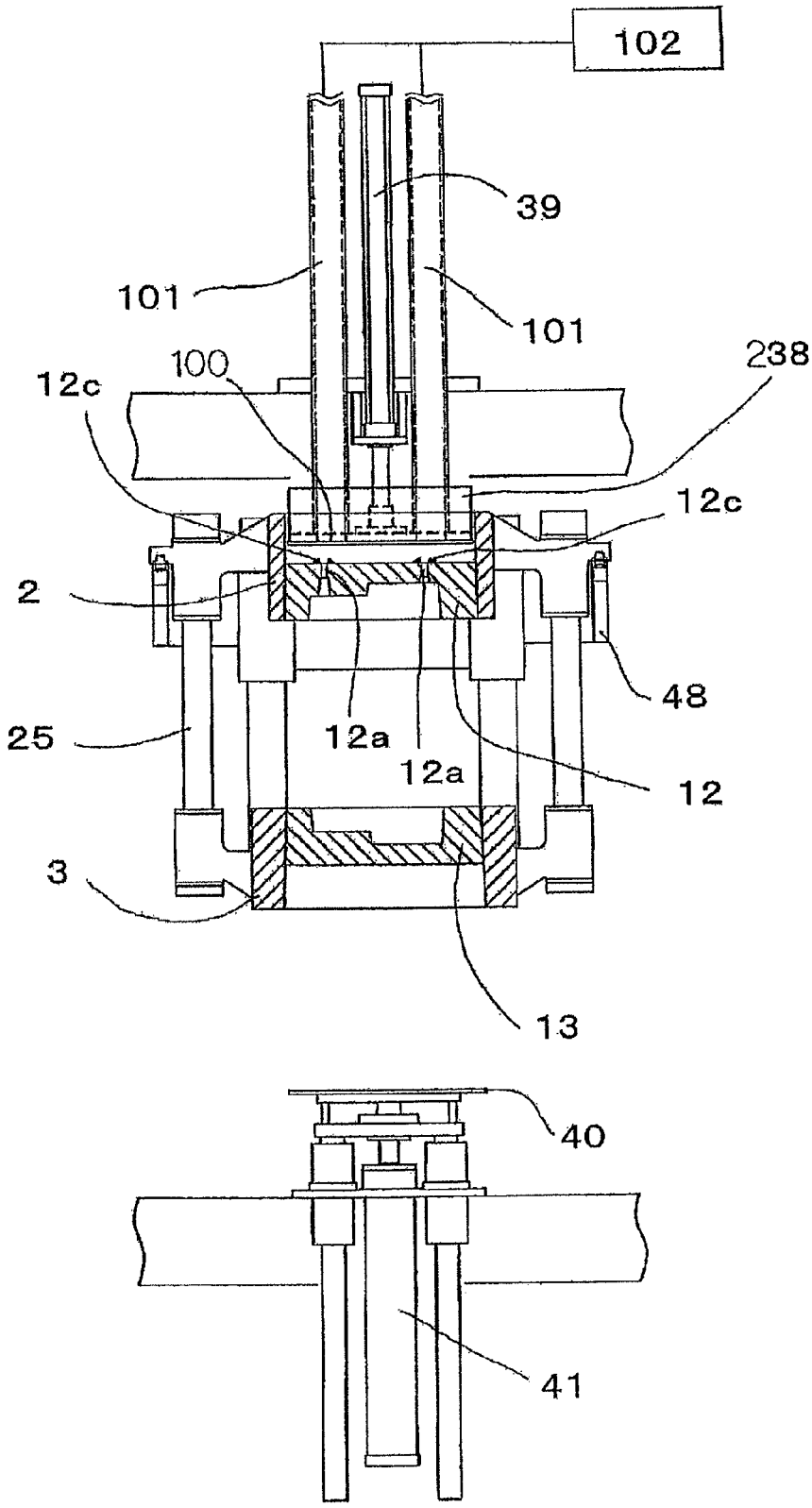

As shown in FIGS. 35 and 36, the pushing member 238, which functions as a device for discharging sand, is moved toward the mold within the upper flask 2 to the location where the suction power is produced (a very small distance). When the device 102 for suctioning sand is activated, the sand on the upper mold is suctioned through the opening 100 and the suction pipe 101 and discharged.

Figure 37:
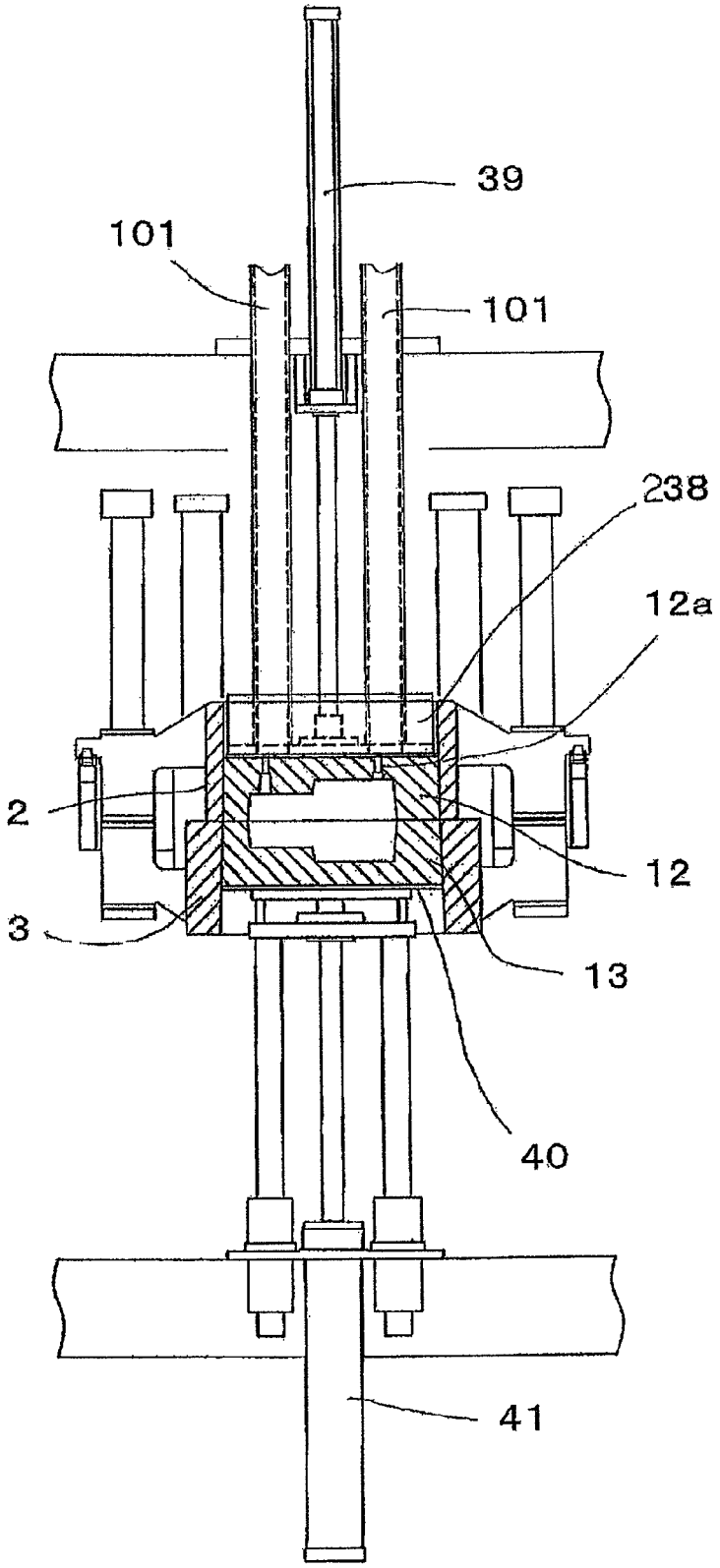
Figure 38:
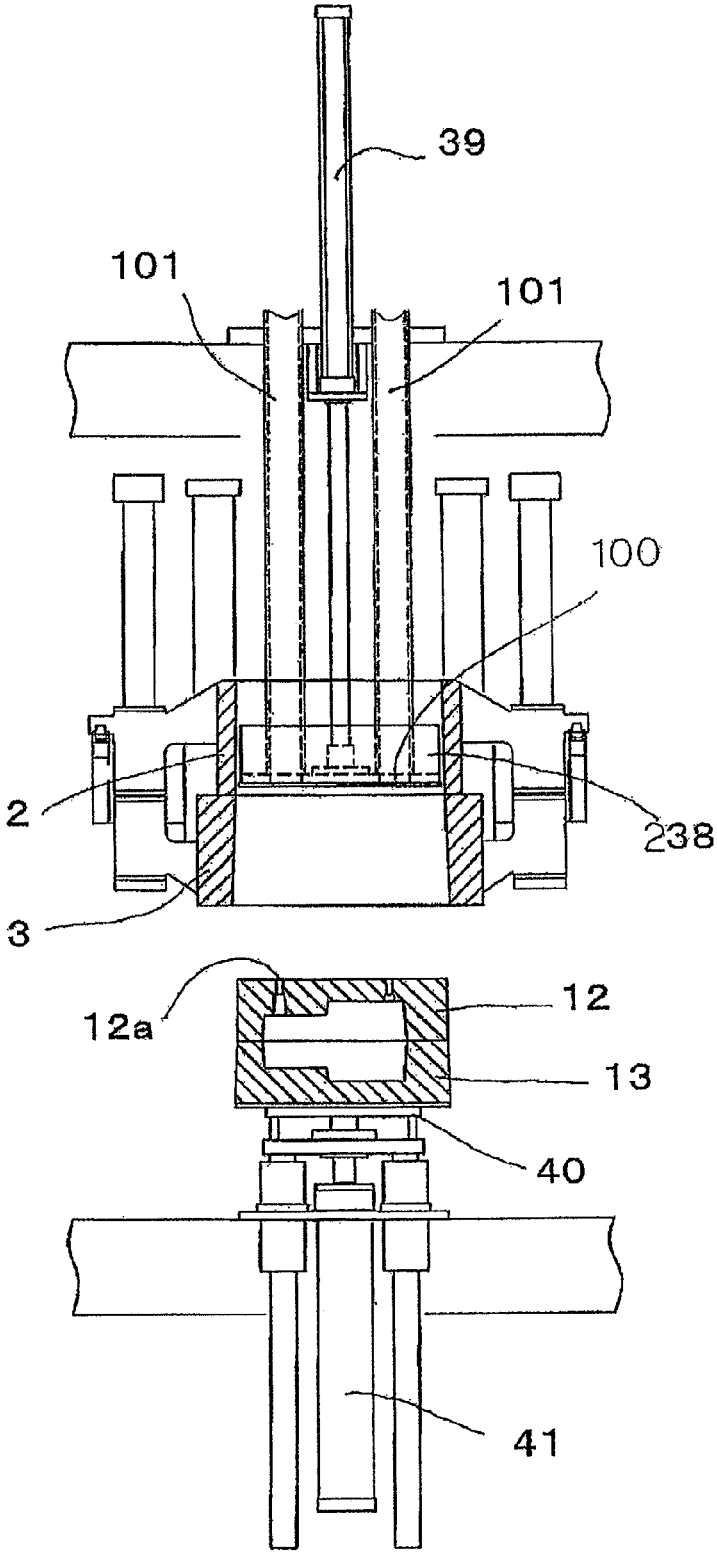

After the sand that has been generated when forming the gas vents is suctioned, the pushing member 238 and the table 40 are lowered while the upper and lower flasks 4 are mounted on the table 40 for receiving the molds, as shown in FIG. 37. Then the pushing member 238 extracts the molds 12, 13 from the upper flask 2 and the lower flask 3, as shown in FIG. 38. After moving the pushing member to the position shown in FIG. 38, only the table 40 is lowered to extract the molds.

The molding method that uses the molding machine 201 that is constructed as discussed above is the same as the molding method that uses the molding machine 1, except that it includes the step of forming gas vents, which step is below described. This method is also characterized in that it comprises steps (1) to (12), so that the long time relative to the cycle time is designated to place cores, to thereby meet the needs for more efficient molding. That is, this method achieves efficient molding where the cycle time is shortened even if many cores are placed. The same effects as those obtained by the method using the molding machine 1 can be obtained.

The molding method using the molding machine 201 is characterized in that, in addition to the steps that are described above, it comprises the step of forming one or more holes at the first or second station for placing a core by the hole-forming device 80, 85 after step (7) and before step (10) (for example in step (8) or (9)) in the mold in the upper flask of the upper and lower flasks that are moved to that position, instead of, or in addition to, placing a core. In other words, it is characterized in these steps. The upper and lower flasks, within which molds were formed in the molding station, are moved to the first station for placing a core. The upper and lower flasks are pivoted so that a core can be placed. The upper and lower flasks are moved to the second station for placing a core. The upper and lower flasks are pivoted so that a core can be placed. At the first or second station for placing a core, one or more holes are formed in the mold in the upper flask of the upper and lower flasks that have been moved to that position. Since gas vents are formed by this method, generating a defect in a cast due to imperfect venting is prevented. This method achieves more efficient molding by shortening the cycle time even if many cores are placed. It also improves the quality of a cast by forming the gas vents.

The molding method using the molding machine 201 is also characterized in that the sand generated by forming a hole is received and discharged by the member 91, 96 for receiving sand that is located in the same station as the hole-forming device is. Since the sand that is scraped when a hole is formed is not dropped to the lower mold, automatic forming of gas vents is achieved and the quality of casts is prevented from deteriorating by that sand.

Further, the molding method using the molding machine 201 is characterized in that the sand that is generated when a hole is formed by the hole-forming device 80, 85, and left on the upper mold 2 is discharged by the pushing member 238, which has the opening 100 for suctioning sand and the means 102 for suctioning sand that is connected to the opening. Thus, by mixing that sand with molten metal when pouring the molten metal the quality of casts is prevented from deteriorating.

The molding method using the molding machine 201 may comprise the step of setting a chiller. Herein, setting a chiller means to place a chiller on the match plate that is disposed between the flasks. The chiller is a metal plate (e.g., a lump of metal, such as cast iron) that is applied to a part of a cast where shrinkage tends to occur, i.e., a part where the thickness changes or where the metal structure is to be dense, so as to quickly cool that part. By comprising the step of setting a chiller a defect (such as shrinkage) due to a slow cooling rate is prevented at any portion where the thickness of a cast is great. The step of setting a chiller may be included in the molding method that uses the molding machine 1.

The step of setting a chiller is performed as follows. The match plate 6 is inserted into the gap between the upper and lower flasks 4 at the molding station. The match plate 6 is fixed by a clamping member (not shown) so as not to be dropped while the rotary frame 43 is being pivoted by the device 5 for pivoting the flasks. Then the rotary frame 43 rotates to move the match plate 6 to the first station for placing a core. Then, an operator sets a chiller on the upper portion of the pattern that is placed on the match plate 6. Then, the rotary frame 43 rotates in the reverse direction to move the match plate back to the molding station while the match plate has a pattern, on which the chiller is placed. Then the clamping member releases the match plate 6. After these steps, the flasks are set, that is, the common steps that are described above are performed.

The molding method using the molding machine 201 may comprise the steps of carrying the match plate 6 in the gap between the upper and lower flasks (the upper flask 2 and the lower flask 3) before step (1) (the step of clamping the match plate), pivoting the upper and lower flasks to move them to the first station for placing a core while the match plate is between them, applying a chiller (not shown) to the match plate 6 that is located between the upper and lower flasks that are moved to the first station for placing a core, and pivoting the upper and lower flasks in the reverse direction to move them to the molding station while the chiller is applied to the match plate that is located between them. When the match plate to which the chiller is applied and the upper and lower flasks are moved back to the molding station, they may be turned by 270° in the positive direction instead of being turned by 90° in the reverse direction. If they are turned in the reverse direction, the device 5 for pivoting the flasks performs the operations that are the reverse of those described with reference to FIGS. 18-23. Thus the device 5 is configured to turn in the reverse direction. By the molding method that includes the step of setting a chiller, shrinkage is prevented when casting by using the molds that are obtained by the method. Thus, molds can be obtained that can produce a cast that has a higher quality. Though in the embodiment a chiller is set, a heating sleeve and the like that are used for heat-retention, i.e., retarding cooling, may be used instead of, or in addition to, the chiller. Further, when the chiller is set, the step of returning in the reverse direction may be used for placing several cores.

The molding machine 201 is characterized in that it comprises the four pairs of upper and lower flasks 4, each of which has the upper flask 2 and the lower flask 3, the device 5 for pivoting the flasks, the match plate 6, a pair of the squeeze plates 7, 8, the storage tank 9 for sand, the device 10 for moving forward and backward around an axis, the squeezing device 11, the device 14 for moving the upper and lower flasks, the device 15 for extracting molds, and the hole-forming device 80, 85. The molding machine 201 moves the upper and lower flasks around the axis to the four stations. Thus, molding, placing cores, and extracting the molds can be efficiently done. That is, since the molding machine 201 has two stations for placing a core, cores are placed in two places. Thus the cycle time is prevented from being long. Further, the molding machine 201 is characterized in that at the first or second station for placing a core gas vents are formed instead of, or in addition to, placing a core. In other words, it is characterized in that one or more holes are formed by the hole-forming device 80, 85 that is installed in the first or second station for placing a core. The holes are formed in the mold in the upper flask of the upper and lower flasks that are moved to that station. Since gas vents are formed by the molding machine, a defect due to imperfect venting is prevented from being generated in a cast. By using the molding machine the cycle time is shortened even if many cores are placed so as to make molding efficient, and the gas vents are formed so as to improve the quality of a cast.

The molding machine 201 is also characterized in that the member 91, 96 for receiving sand is provided in the same station as the station where the hole-forming device 80, 85 is provided. It receives the sand 12*b* that is generated when a hole is formed and discharges it from the machine, so that the sand 12*b* is not left on the lower mold or the core. Thus automatically forming a hole is achieved and deterioration in the quality of a cast due to that sand is prevented.

Further, the molding machine 201 is characterized in that it has a pushing member 238 on which the opening 100 for suctioning and the device 102 for suctioning are provided. Since the sand that is generated when a hole is formed by the hole-forming device 80, 85 and that is left on the upper mold 2 is discharged, deterioration in the quality of a cast due to that sand being mixed in the molten metal when pouring it into the molds is prevented.

Further, the molding machine 201 is characterized in that it has the device 58 for locking the position. Since a hole is formed by the hole-forming device 80, 85 while the rotary frame 43 is locked by the device 58 for locking the position, a hole is reliably and accurately formed. Thus, the quality of a cast is improved.

The molding machine and the molding method using it are characterized in that the hole-forming device 80, 85 and so on are provided in the station for placing a core. It is applicable when three or more stations, for example, three stations or five stations, are provided.

Some embodiments of the present invention have been described. Still, many variations can be made without departing from the spirit and scope of the present invention. For example, some of the steps described in this specification may be performed in a different order or orders.

EXPLANATION OF DENOTATIONS

1. a molding machine
2. an upper flask
3. a lower flask
2*a*, 3*a*. a port for introducing molding sand
4. upper and lower flasks
5. a device for pivoting the flasks
6. a match plate
7, 8. a squeeze plate
9. a storage tank for sand
10. a device for moving forward and backward around an axis
11. a squeezing device
14. a device for moving the upper and lower flasks
15. a device for extracting the molds
16. a revolute joint
17. a device for moving a storage tank for sand forward and backward around an axis
18. a controller (a controlling means)
80, 85. a hole-forming device
90, 95. a device for discharging sand

The invention claimed is:

1. A flaskless molding machine comprising:

four pairs of upper and lower flasks, each pair comprising an upper flask and a lower flask, the upper flask and lower flask having an opening and a port for introducing molding sand that is formed on respective side walls of the upper flask and the lower flask;

a device for pivoting the flasks for pivoting the four pairs of upper and lower flasks so as to move the upper and lower flasks via at least four stations, including a molding station, a first station for placing a core, a second station for placing a core, and a station for extracting molds;

a match plate to be inserted into, and taken out from, a gap between the pair of the four pairs of the upper and lower flasks that is located at the molding station;

a pair of squeeze plates that are inserted through the openings of the pair of upper and lower flasks, respectively, while the match plate is clamped by the upper and lower flasks, so as to form an upper mold cavity and a lower mold cavity;

a storage tank for sand having a pair of nozzles for introducing molding sand that are formed downwardly from a bottom of the tank;

a device for moving the upper flask and lower flask forward and backward around an axis so that the ports for introducing molding sand receive the molding sand from the pair of nozzles for introducing molding sand;

a squeezing device for moving the pair of squeeze plates toward the match plate so as to squeeze the molding sand in the upper and lower mold cavities, and for moving the pair of squeeze plates for forming the upper and lower mold cavities, the squeezing device being moved around the axis by the device for moving forward and backward around an axis, the molding sand having been filled in the upper and lower mold cavities;

a device for moving the upper and lower flasks to have them retract from each other so that the match plate is separated from an upper mold and a lower mold and to have them come close to each other, the upper and lower molds being formed in the upper and lower mold cavities, respectively; and a device for extracting the molds from the upper and lower flasks while the upper and lower molds are stacked, the upper and lower molds having been formed in the upper and lower flasks, the upper and lower flasks having been moved to the station for extracting the molds via the first and second stations for placing a core by the device for pivoting the flasks, the upper and lower flasks containing the molds from which the match plate is separated, wherein the device for pivoting the flasks is equipped with a revolute joint that connects an air-supplying tube or a hydraulic tube to a rotary portion so that the rotary portion continually rotates in one direction when the device for pivoting the flasks moves the upper and lower flasks via the at least four stations.

2. The flaskless molding machine of claim 1, wherein the hydraulic tube that is connected via the revolute joint is used for a cylinder for vertically moving the upper flask.

3. The flaskless molding machine of claim 1 or 2, wherein the device for pivoting the flasks comprises a rotary frame that holds the upper and lower flasks and rotates, a frame for transmitting a driving force that is located under the rotary frame and transmits a driving force to the rotary frame, a switch for switching between a connected state where the frame for transmitting a driving force is connected to the rotary frame and a disconnected state where the frame for transmitting a driving force is disconnected from the rotary frame, and a driving cylinder to move the frame for transmitting a driving force forward and backward around an axis, the driving cylinder being provided in a platform, wherein the driving cylinder has a rod of which a leading end is attached to the frame for transmitting a driving force so as to move the frame for transmitting a driving force within 90° around the axis in a direction and a reverse direction, and wherein the switch changes to the connected state to rotate the rotary frame in one direction when the frame for transmitting a driving force is moved in the one direction and changes to the disconnected state when the frame for transmitting a driving force is moved in a direction reverse to the one direction.

4. The flaskless molding machine of claim 3, wherein a concave is formed on a lower face of the rotary frame;

wherein the switch is a cylinder for a connection, the cylinder for a connection having a base that is fixed to the frame for transmitting a driving force and having a rod facing upward; and wherein the switch changes to the connected state by elongating the rod to engage the concave of the rotary frame and to the disconnected state by contracting the rod to disengage from the concave.

5. The flaskless molding machine of claim 4, wherein the device for pivoting the flasks comprises a device for positioning the rotary frame in a direction of a rotation;

wherein the device for positioning the rotary frame includes a cylinder that is provided on the platform, the cylinder having an upward-facing rod; and wherein the rotary frame is positioned by elongating the upward-facing rod to engage the concave of the rotary frame.

6. The flaskless molding machine of claim 1, wherein the device for moving forward and backward around an axis moves the upper and lower flasks around the axis from a position where the upper and lower flasks vertically face each other to a position where the upper and lower flasks horizontally face each other so that the ports for introducing molding sand can receive the molding sand from the pair of nozzles for introducing molding sand.

7. The flaskless molding machine of claim 1, further comprising:

a device for moving the storage tank for sand forward and backward around an axis that moves the storage tank for sand in a direction that is reverse to the direction of movement of the upper and lower flasks;

wherein the device for moving forward and backward around an axis moves the upper and lower flasks around the axis from a position where the upper and lower flasks vertically face each other to an oblique position that is between the position where the upper and lower flasks vertically face each other and a position where the upper and lower flasks horizontally face each other; and wherein the device for moving the storage tank for sand forward and backward around an axis moves the storage tank for sand in a direction that is reverse to the direction of movement of the upper and lower flasks so that the ports for introducing molding sand can receive the molding sand from the pair of nozzles for introducing molding sand.

8. The flaskless molding machine of claim 1, further comprising:

a device for moving the storage tank for sand forward and backward around an axis that moves the storage tank for sand in a direction that is reverse to the direction of movement of the upper and lower flasks; and a controller for determining a first position or a second position when filling the molding sand based on a pattern that is placed on the match plate and for controlling the device for moving forward and backward around an axis and the device for moving forward and backward the storage tank for sand around an axis;

wherein, if the first position is determined, the controller controls the device for moving forward and backward around an axis to move the upper and lower flasks around an axis from a position where the upper and lower flasks vertically face each other to a position where the upper and lower flasks horizontally face each other so that the ports for introducing molding sand can receive the molding sand from the pair of nozzles for introducing molding sand; and wherein, if the second position is determined, the controller controls the device for moving forward and backward around an axis and the device for moving the storage tank for sand forward and backward around an axis to move the upper and lower flasks around an axis from the position where the upper and lower flasks vertically face each other to an oblique position between the position where the upper and lower flasks vertically face each other and the position where the upper and lower flasks horizontally face each other and to move the storage tank for sand around an axis in a direction that is reverse to the direction of motion of the upper and lower flasks so that the ports for introducing molding sand can receive the molding sand from the pair of nozzles for introducing molding sand.

9. The flaskless molding machine of claim 1, wherein the flaskless molding machine carries out at least the steps of:

(1) clamping a match plate by an upper flask and a lower flask, the upper and lower flasks being located at a molding station, the upper and lower flasks vertically facing each other, and each of the upper and lower flasks having an opening and a port for introducing molding sand that is provided on their side walls;

(2) forming an upper mold cavity and a lower mold cavity by inserting a pair of squeeze plates into the respective openings of the upper and lower flasks that clamp the match plate;

(3) positioning the ports for introducing molding sand of the upper and lower flasks by moving the upper and lower flasks around an axis so that molding sand is filled into the upper and lower flasks from a pair of nozzles for introducing molding sand that are formed downwardly from the bottom of a storage tank for sand, the upper and lower flasks forming the upper and lower mold cavities;

(4) filling the upper and lower mold cavities with the molding sand from the storage tank for sand through the ports for introducing molding sand;

(5) forming upper and lower molds in the upper and lower flasks by squeezing the molding sand that is filled in the upper and lower mold cavities by moving the pair of squeeze plates toward the match plate;

(6) moving the upper and lower flasks around the axis back to the position where the upper and lower flasks vertically face each other;

(7) separating the match plate from the molds that are formed in the upper and lower flasks by moving the upper and lower flasks to have them retract from each other;

(8) pivoting the upper and lower flasks having the molds therein from the molding station to a first station for placing a core so that a core can be placed in the upper and lower flasks;

(9) pivoting the upper and lower flasks further in the same direction to move the upper and lower flasks from the first station for placing a core to a second station for placing a core so that a core can be placed in the upper and lower flasks;

(10) pivoting the upper and lower flasks further in the same direction to move the upper and lower flasks from the second station for placing a core to a station for extracting the molds;

(11) moving the upper and lower flasks having the molds therein to have them come close to each other at the station for extracting the molds so that the upper and lower flasks are stacked; and

(12) extracting the upper and lower molds from the upper and lower flask, while the upper and lower molds are stacked, by a device for extracting the molds that has a member to go in the upper and lower flasks;

wherein respective pairs of the upper and lower flasks are put in at least four stations, including the molding station, the first station for placing a core, the second station for placing a core, and the station for extracting the molds in conditions that are suitable for the steps to be performed by the respective stations, each pair of the upper and lower flasks consisting of an upper flask and a lower flask; and wherein stacked flaskless upper and lower molds are formed one after the other by moving the upper and lower flasks via the at least four stations.

10. A flaskless molding machine comprising:

four pairs of upper and lower flasks, each pair comprising an upper flask and a lower flask, the upper flask and lower flask having an opening and a port for introducing molding sand that is formed on respective side walls of the upper and lower flask;

a device for pivoting the flasks for pivoting the four pairs of upper and lower flasks so as to move the upper and lower flasks via at least four stations, including a molding station, a first station for placing a core, a second station for placing a core, and a station for extracting molds;

a match plate to be inserted into, and taken out from, a gap between the pair of the four pairs of the upper and lower flasks that is located at the molding station;

a pair of squeeze plates that are inserted through the openings of the pair of upper and lower flasks, respectively, while the match plate is clamped by the upper and lower flasks, so as to form an upper mold cavity and a lower mold cavity;

a storage tank for sand having a pair of nozzles for introducing molding sand that are formed downwardly from a bottom of the tank;

a device for moving the upper flask and lower flask forward and backward around an axis so that the ports for introducing molding sand receive the molding sand from the pair of nozzles for introducing molding sand;

a squeezing device for moving the pair of squeeze plates toward the match plate so as to squeeze the molding sand in the upper and lower mold cavities, and for moving the pair of squeeze plates for forming the upper and lower mold cavities, the squeezing device being moved around the axis by the device for moving forward and backward around an axis, the molding sand having been filled in the upper and lower mold cavities;

a device for moving the upper and lower flasks to have them retract from each other so that the match plate is separated from an upper mold and a lower mold and to have them come close to each other, the upper and lower molds being formed in the upper and lower mold cavities, respectively;

a device for extracting the molds from the upper and lower flasks while the upper and lower molds are stacked, the upper and lower molds having been formed in the upper and lower flasks, the upper and lower flasks having been moved to the station for extracting the molds via the first and second stations for placing a core by the device for pivoting the flasks, the upper and lower flasks containing the molds from which the match plate is separated;

a hole-forming device that is provided in the first or second station for placing a core;

wherein the hole-forming device forms one or more holes in a mold in the upper flask of the upper and lower flasks that is moved to the station for placing a core where the hole-forming device is provided; and a member for receiving sand that is provided in the station for placing a core where the hole-forming device is provided;

wherein the member for receiving sand is inserted under the upper flask when a hole is formed, receives the sand that is generated when the hole is formed, and discharges the sand from the flaskless molding machine.

11. The flaskless molding machine of claim 10, wherein the device for extracting the molds has a pushing member that enters the upper and lower flasks that are stacked from above and pushes the upper and lower molds in the upper and lower flasks downwardly; and wherein the pushing member has an opening for suctioning sand on the upper mold and a suctioning device that is connected to the opening.

12. The flaskless molding machine of claim 11, wherein the device for pivoting the flasks comprises a rotary frame that holds the upper and lower flasks and rotates and a locking device for positioning and locking the rotary frame in a direction to pivot the flasks; and wherein, while the rotary frame is locked by the locking device, the hole-forming device forms one or more holes in a mold in the upper flask that is located in the first or second station for placing a core where the hole-forming device is provided.

* * * * *